US011920352B2

(12) United States Patent
Nelson, Jr.

(10) Patent No.: US 11,920,352 B2
(45) Date of Patent: Mar. 5, 2024

(54) ROOF CONSTRUCTION

(71) Applicant: Tandem Building Products, LLC, Kenner, LA (US)

(72) Inventor: G. Paul Nelson, Jr., Metairie, LA (US)

(73) Assignee: TANDEM BUILDING PRODUCTS, LLC, Kenner, LA (US)

( * ) Notice: Subject to any disclaimer, the term of this patent is extended or adjusted under 35 U.S.C. 154(b) by 302 days.

(21) Appl. No.: 17/371,557

(22) Filed: Jul. 9, 2021

(65) Prior Publication Data

US 2022/0064955 A1 Mar. 3, 2022

Related U.S. Application Data

(60) Provisional application No. 63/071,470, filed on Aug. 28, 2020, provisional application No. 63/049,747, filed on Jul. 9, 2020.

(51) Int. Cl.

| | |
|---|---|
| ***E04D 3/30*** | (2006.01) |
| ***E04D 3/36*** | (2006.01) |
| ***E04D 3/366*** | (2006.01) |
| ***E04D 13/00*** | (2006.01) |

(52) U.S. Cl.

CPC ..... *E04D 3/3607* (2013.01); *E04D 3/30* (2013.01); *E04D 3/366* (2013.01); *E04D 13/00* (2013.01)

(58) Field of Classification Search

CPC ..... E04D 3/3607; E04D 3/30; E04D 3/366; E04D 13/00

USPC ..... 52/220.1

See application file for complete search history.

(56) References Cited

U.S. PATENT DOCUMENTS

| | | | | |
|---|---|---|---|---|
| 4,034,532 | A | 7/1977 | Reinwall, Jr. | |
| 4,796,403 | A | 1/1989 | Fulton et al. | |
| 5,001,882 | A | 3/1991 | Watkins et al. | |
| 5,557,903 | A * | 9/1996 | Haddock | E04D 3/3607 52/537 |
| 5,600,971 | A * | 2/1997 | Suk | E04D 3/3608 52/537 |
| 5,743,063 | A | 4/1998 | Boozer | |
| 9,243,416 | B2 * | 1/2016 | Chism | E04H 7/06 |

OTHER PUBLICATIONS

International Search Report, dated Nov. 3, 2021.
Written Opinion of the International Searching Authority, dated Nov. 3, 2021.

* cited by examiner

*Primary Examiner* — Mark R Wendell
(74) *Attorney, Agent, or Firm* — Garvey, Smith & Nehrbass, Patent Attorneys, L.L.C.; Seth M. Nehrbass; Fabian M. Nehrbass

(57) ABSTRACT

A roof apparatus provides a uniquely configured clip assembly or interface that connects upper roof panels to under supporting beams. In one embodiment, the clip or interface provides multidirectional movement of roof panels to under support beams. In one embodiment, a specially configured U-beam can be an understructure beam that carries utilities such as piping or electricity.

20 Claims, 35 Drawing Sheets

48
42
45

44
46
48

42
44
46
45
48

48
46
45
44
46
45
42
44
46
45
48

44
45

47
45
46
45
42
47
45
46
45
47
46
45
45
47

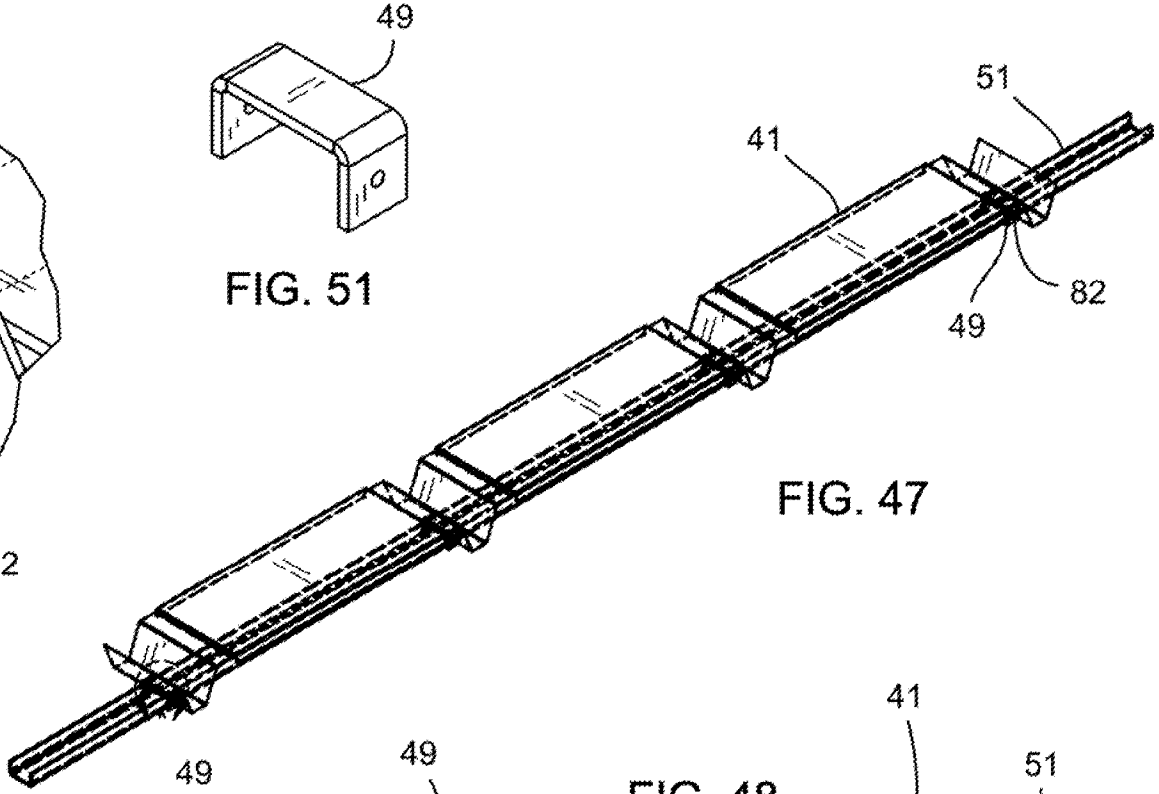
FIG. 47
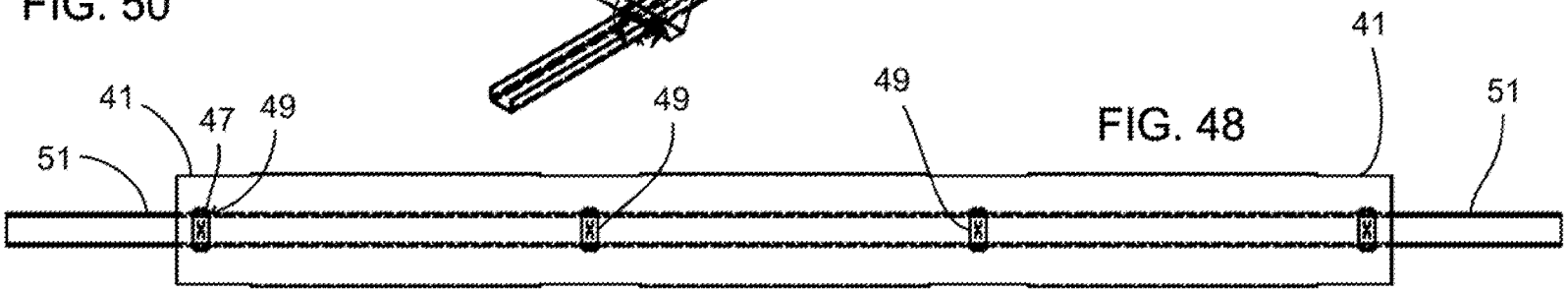
FIG. 48
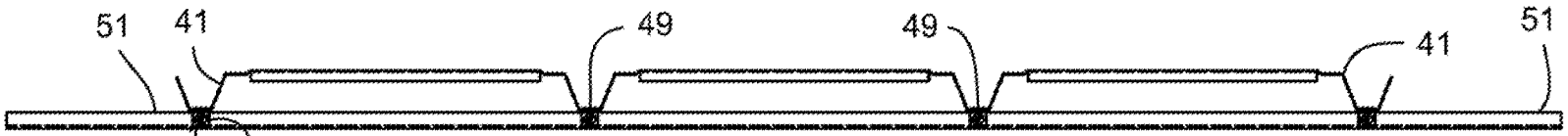
FIG. 49
FIG. 51
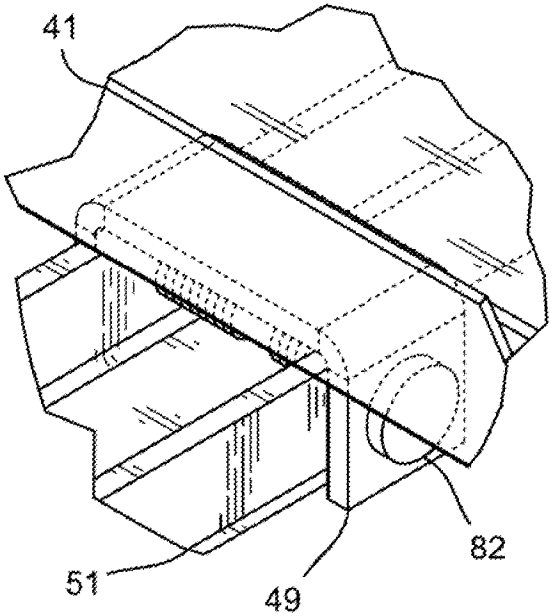
FIG. 50

60
61
62
63
83

83
83
83

54
55
57
58
55
56

54
83
83
83

59
83
83

59
57
55
55

59
83
83
83
83

ROOF CONSTRUCTION

CROSS-REFERENCE TO RELATED APPLICATIONS

Priority of U.S. Provisional Patent Application Ser. No. 63/049,747, filed Jul. 9, 2020 and U.S. Provisional Patent Application Ser. No. 63/071,470, filed Aug. 28, 2020, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a uniquely configured metal roof apparatus that features a multi-directional attachment between uppermost roof panels and under supporting beams. In one embodiment fasteners are employed that enable shear strength to determine failure. In another embodiment, valley sections collect and channel water. In another embodiment, under support beams are configured to contain utilities such as piping, electrical wiring, cabling and conduit.

2. General Background

There are two classifications of roof systems; low-slope and steep slope. Steep slope systems are typically quantified as having a slope greater than 3 inches on 12 inches. High pitched roofs do not let water sit, so asphalt shingles, tiles and metal panels are ideally suited for these types of pitched roofs. Roofs are considered low-slope roofs below 3:12 pitch.

Low-slope roofs typically have a minimum slope of one-fourth inch vertical to twelve inch horizontal (¼:12 or 2 percent) depending on the roofing material. Modern low-slope roof or flat roofs tend to use a continuous membrane covering that are applied as continuous sheets, bonded together with heat-welding or adhesives.

Conventional structures with low slope roofs are comprised of a steel deck, lightweight concrete, rigid insulation, fire-rated cover board and one of the following roof membranes; built up roof (BUR), polymer-modified bitumen sheet membranes or single-ply membranes such as TPO or EPDM.

Steel deck is a cold formed corrugated steel sheet supported by steel joists or beams. It is used to support concrete or insulating membrane of a roof. B Deck is strong, lightweight, economical, and easy to install and is the most common structural roof deck. Polyisocyanurate is a ridged insulation board made of closed cell foam. Polyisocyanurate is a common commercial roofing product, used under roofing membranes to insulate the building or structure. It can also be use on walls.

For low-slope roofs with slopes greater than 1:12 and steep sloped roofs, metal panels are used as the roof membrane. With structural metal panels, draped insulation or radiant barrier is used instead of rigid insulation over a structural metal deck.

Metal roof and wall panels generally fall into one of two categories: 1) structural or 2) nonstructural. Structural panels are able to support live loads while spanning across structural members (e.g., up to six feet). These types of panels need no decking beneath them. These panels are typically installed over structural members such as Z and C purlins or girts and wood or steel web joists. Nonstructural, or what is sometimes referred to as architectural panels, cannot support live loads without a structural wood or metal deck beneath them. R-panels and some types of standing seam panels are structural panels. Many types of standing seam panels are nonstructural panels.

All metal roof panels are unidirectional in profile meaning the panel has a top and bottom side with the top side facing away from the interior of the building. All panel profiles are strongest in design when force is applied to the underside. When force is applied to the topside of roof panels, they tend to deform or fail in the location of the impact or force.

The thickness of metal used in metal roofing and wall panels is generally limited to 22-gauge sheet metal. Most metal panels used are 26 and 24 gauge, but panels as light as 29 gauge have been used. To achieve wind ratings up to 185 mph, many manufacturers use 22-gauge metal. If heavier gauge metal was used to achieve higher wind ratings and the current methods of attachment were used, the panels would exert repeated overstresses to the building's substructure possibly causing catastrophic failure of the building supports.

Metal used in roof and wall panels are typically mild steel. Mild steel contains a smaller amount of the hardening alloy—carbon—than other carbon steels. It has a low tensile strength of around 400 MPa. Advanced High-Strength Steel (AHSS) is a new generation of steel that provides high-strength (up to 2,000 MPa) and durability while maintaining formability. Mild steel is used in the roof/wall industry while AHSS is not. While a lighter gauge panel could be used if AHSS comprised the metal panel compared to that of mild steel, AHSS is not used because current roof/wall technology cannot handle the expansion/contraction forces exerted by AHSS on the building's infrastructure.

For a building's infrastructure, a beam is the main load-bearing structural element of a roof. It supports the weights of joists, purlins and other building elements. A joist is a horizontal member that generally runs across a building and is supported by a beam. The first joist was a Warren truss type, with top and bottom chords of round bars and a web formed from a single continuous bent bar. This design continues to be used today as well as other designs such as open web steel joist or OWSJ.

The open web steel joist (OWSJ) is a steel truss consisting of parallel chords and a triangulated web system, proportioned to span between bearing points. The main function of an OWSJ is to provide direct support for the roof and to transfer the load imposed on the roof to the structural frame, i.e., beam and column.

In order to accurately design an open web steel joist, engineers consider the joist span between bearing points, joist spacing, slope, live loads, collateral loads, seismic loads, wind uplift, deflection criteria and maximum joist depth allowed.

While open web steel joists can be adapted to suit a wide variety of architectural applications, the greatest economy will be realized when utilizing standard details. K-Series and L-Series Joists are standardized regarding depths, spans, and load-carrying capacities. There are 72 separate designations in the Load Tables, representing joist depths from 10 inches through 48 inches in 2-inch increments and spans through 60 feet. All web joists utilize welding to join the individual components of the joist together.

Girts and purlins are horizontal structural members just like joists. A girt is a horizontal structural member in a framed wall that provides lateral support to the wall panel to resist wind loads. Purlins perform the same service for the roof panels. Girts and purlins may also be called sheeting rails.

Girts and purlins come in two primary shapes: C and Z. These members are commercially available in depths from 4 inches to 12 inches and are roll-formed from galvanized steel. They are primarily used to provide lightweight, economical, efficient roofing and cladding support systems for framed structures. These members do not provide as much load-carrying capacities as web joists.

Structural roof panels are able to support live loads while spanning (e.g., up to six feet) across structural members such as the steel web joists, Z purlins or C purlins. The wind rating a roof or wall can sustain is determined by both the strength of the panel and the strength of the structural member for a given span. Current standard structural members are not able to withstand wind ratings above 200 mph when spaced 4 feet on center or more and support spans exceed 35 feet.

BRIEF SUMMARY OF THE INVENTION

1. General Discussion of the Present Invention

The present invention provides a roofing and/or wall system employing specially configured roof/wall clips, roofing/wall panels, and high strength infrastructure supports that also provide built-in lighting, cable trays, electrical wiring and/or fluid conduits. In one embodiment, the present invention provides a specially configured clip apparatus that will allow movement in the roof panels in all directions—a 360-degree radius, while achieving superior attachment strength when compared to a standard roof clips. Mechanical attachments are based on utilizing the stronger properties of shearing versus pullout.

The present invention allows roofs and walls to achieve a high wind resistance (e.g., 300 mph) while achieving 1,000+ psi on mechanical attachment.

The present invention allows heavier gauge roof panels used in roofing applications without exerting destructive thermal movement against support members.

The present invention also utilizes a unique panel profiles that allows them to be inverted or used upside down. When used upside down, ribs face down, with a panel cap installed over the openings. The panels thus make up a metal plane with no rib protrusions to block or deflect water flow. The inverted ribs become water channels to prevent ponding water on the main surface of the roof membrane.

The present invention can be utilized as a horizontal member providing support of and attachment for a roof membrane or roof deck, transferring load of the roof membrane/deck to the vertical/support members.

The present invention can be prefabricated to house lighting, electrical wiring bundles, ductwork (e.g., air conditioning), and sprinkler systems while still providing horizontal support of the roof membrane/deck.

The design of the present invention can utilize mild steel or advanced high strength steels (AHSS) facilitating higher load capacities. The present invention does not require metal welding of components to achieve its load bearing capacities.

The design of the present invention allows a roof/wall panel profile to be used with the ribs of the panel facing inwards. When the panel of the present invention is installed in the inverted position with the ribs down, the roof systems simulate a conventional low-slope system, but one made of metal. The surface of the roof is smooth, which allows the free flow of water. Because of the ribs being inverted, the inverted system has a spring effect, which absorbs and redirects the energy of impacts. The inverted roof/wall system can achieve high wind uplift resistance (e.g., 300 mph) with even 24-gauge metal.

The design of the present invention also allows for panels to be run in one long run equal to the distance from the eave to the ridge. These long panels can be up to 800 feet long. The design of the present invention also allows metal panels of much thicker gauges to be used to not only increase the wind rating to a level greater than any level of storm can generate, but to also withstand impacts from wind born debris. The present invention allows the roof/wall panels to expand and contract in any direction without any of the pressure from the movement to the building infrastructure. The present invention allows for the use of Advance High Strength Steel (AHSS) on any or all the components of the invention. The present invention allows lighter gauges of metal to be used while increasing the structural strength of the components compared to those of mild steel.

The inverted panel is unique to the marketplace in that it is installed with the panel's rib face down with the pan area between the ribs facing up. When panel caps are installed over the ribs, the roof system becomes a flat metal roof system. The low portion of the inverted panel is attached to a 360-degree clip by fasteners passing through the side wall of the rib and into a clip bracket thus utilizing shearing forces instead of pullout. Water is free to move across the surface of the roof without being impeded by panel ribs.

The inverted panel of the present invention has ribs that become water channels funneling water off the roof system. These water channels prevent ponding of water on the flat part of the exposed roof surface created by the panel and panel cap. All conventional low-slope roofs suffer from ponding water and the manufacturer's warranties list ponding water as an excuse for voiding their warranties.

By inverting the ribs, the ribs of the panel are protected from being damaged by flying debris and/or people walking on the ribs. Damaged ribs are one of the leading causes of metal roof failures.

The rib walls can be between about 68° and 72° angle. Any angle can be used depending on the panel stiffness required for the desired wind load. The gauge of the roof panels can be any gauge (e.g., between 10 gauge and 24 gauge). The inverted panel can be 22 gauge for most applications and 24 gauge for most roof-overs.

The panel cap allows the low-slope application by closing off the valley of the panel rib. The panel caps can be installed to close off and watertight the valley of the panel ribs through sealing of the panel/panel cap offset. For low-slope applications, caps can be installed to allow excess water to flow into the panel's water channels through the non-offset panel/panel cap.

The panel cap can be mechanically fastened via snap locks in the valley and sealed to the panel in the offset portion of the panel for watertight capabilities. For applications allowing water to enter the water channels, the panel cap is only mechanically fastened via snap locks in the valley of the panel ribs. The panel cap can be mechanically attached by a panel cap clip, which is fastened to the side wall of the panel rib.

The panels and panel caps of the present invention can be roll formed (e.g., up to a length of 800 feet). The panel caps are preferably made of 24-22 gauge but can be made of any gauge metal (e.g., up to 10-gauge metal). Both the panels and panel caps can be made of mild steel or AHSS metal.

The present invention features a specially configured all direction (e.g., 360 degree) clip that allows movement in the roof system in a 360-degree radius. The clip design of the present invention can be installed on any style or size of structural member including Z and C purlins/girts, hat channel, wood or steel web joists, wood rafters and/or wood decking with shear resistance being the common factor among all mechanical fasteners instead of pull-out resistance. These screws or fasteners can be used to tie the clip to the structural member in such a way that shearing forces would be required to dislodge the clip instead of pullout forces. Shearing forces of metal are greater than screw pull out with shearing being for example about five times greater than pullout forces.

The 360-degree clip of the present invention is the mechanism that attaches a roof or wall panel to the structural member. When the 360-degree clips are installed on an infrastructure member, they are installed abutting each other. This eliminates the repeated use of pop chalk lines to make sure each anchor point is properly aligned with other anchor points up and down slope of the roof system.

By using Advance High Strength Steel (AHSS) for the 360-degree clip material, higher shear forces can be achieved while using lighter gauge metal than when using mild steel. The roof/wall panel can also be fastened based in such a way to utilize shear forces. When AHSS is used for the clip components, then the shearing resistance can be over 10 times greater than pull-out resistance of current clip designs.

The clip design of the present invention includes a bracket/shear connector, sliding anchor, top plate, and bottom plate. The main part of the clip that facilitates a roof panel to be installed with the ribs facing inward is a bracket. This bracket provides the structural strength preventing the inverted ribs from flattening out when force is applied downwardly to the topside of the panel. The panels are fastened to the brackets by screws passing through the panel cap clip and side walls of the inverted rib. With prior art clips, resistance to upward force is accomplished by the pull-out resistance provided by screw threads. Pull-out forces for most screws with the ordinary roof clips are approximately 220 pounds per square inch. Shearing resistance of the present invention is more than 5 times this amount while using the same type of screws. When thicker gauge metal or AHSS is used for the bracket, then the shearing resistance can be over ten times greater.

Standard industry panels are currently not glued to roof clips due to a restriction of thermal movement and the directional limitations of that thermal movement. The clip design of the present invention allows the roof panel to be glued to the pan of the bracket without hindering thermal movement and does not have directional limitations. By gluing the panel flats to the top of the bracket pan, the panel is not allowed to crown during storm-caused overpressures. To provide a continuous bracket pan between adjacent clips, a bracket bridge can be installed in the two outside valley walls at the end of both brackets. The bracket bridge has the same profile as the brackets it connects.

Currently, all metal roof panels start to crown with pressures as little as 5 pounds per square foot. Current metal roof systems can become mechanically unsealed and fail at crowning pressure as low as 50 pounds per square foot. With the panel of the present invention glued to the bracket, the panel resists crowning at pressures as high as 3,000 pounds per square foot.

The bracket resists the upward crowning forces through stiffening ribs on both sides of the bracket pan. The bracket also matches the profile of the roof panel including the ones with and without panel cap recesses. The bracket is attached to the sliding anchor by a shear connector. This connection provides resistance to shear forces. The shear connector passes through two slots in each valley of the inverted rib section of the bracket and then fastened to both vertical walls of the sliding anchor.

A sliding anchor provides free movement of the 360-degree clip. The sliding anchor can have any profile, but the U-shaped slide is the standard profile with the bottom flange of the U-shape being the weight-bearing portion of the slide. The sliding anchor can be any length and have as many anchor points as required. It can also be any width and can have any height, but 2" width and ¾" high vertical walls is exemplary. To increase the strength of the sliding anchor, multiple sliding anchors can be inlaid into each other. The sliding anchor can be made of any metal metallurgy, thickness, type or shape to allow a shearing-type connection to the bracket of the clip assembly. Powder coating the anchor plate and sliding anchor with an ultra-hard high-density coating will allow the sliding anchor to easily slide within the anchor plate indefinitely. With the bracket attached to the sliding anchor via the shear connector, this combination is the subassembly of the 360-degree clip. The subassembly is housed between the top and bottom plates of the clip assembly.

A top plate allows the subassembly free movement within the clip assembly while preventing the subassembly from being pulled off the infrastructure support. The top plate defines and limits the amount of expansion/contraction movements by the size and shape of the cutouts of the bracket openings. The top plate and bracket openings preferably allow for anything from no movement to up to 12 inches on some projects (and more if required). The top plate and bracket openings preferably allow for up to about 1.5 inches movement per 100 feet of roof length. However, they can be configured in any size of shape depending on roof application to allow for more or less movement.

The top plate can be any length or width. As an example, the top plate for a Z or C purlin application will be about six feet long (running along the length of the purlin, girt or web joist) and about four inches across the top flange of the structural member. The top plate can be made of any gauge of metal but is expected to be made of 18-16 gauge. The top plate can be made of mild-steel or AHSS depending on the uplift strength required. The AHSS metallurgy would allow the top plates to last longer than ones of mild-steel due to the AHSS abrasion-resistance properties. By using advance high strength steel (AHSS) for the top plate material, higher shear factors can be achieved for a given thickness of metal. The cross-section of the top plate is limited to the cross-section of the weight-bearing area of the bottom plate. The top plate attaches to the bottom plate via screws or fasteners. Glue can be used as well for this attachment.

While the top plate limits the direction and amount of free movement of the sliding anchor, a bottom plate has different functions. The bottom plate provides the weight-bearing and sliding surface for the bracket subassembly. The bottom plate can also be configured for any shape that facilitates the shearing-type connections to infrastructure members.

For Z and C purlin applications, both the top and bottom anchor plates can have a 90° angle on both ends of the plates. Glue can be applied to the inside of the 90° angles of the bottom plate in a way that when the top and bottom plate are put together the glue bonds them together.

For web joist applications, the bottom plate is not limited to the surface area of the top flange width of the web joist but can extend beyond the dimensions of the web joist's top flange to allow for a longer movement of the bracket subassembly. For roof-over application where the metal roof is installed over an existing low-slope roof, the bottom plate can be shaped into a U-channel. The U-channel bottom plate is attached to the top flange of the structural member or to the flats of a roof deck by mounting screws that pass through the existing low-slope roof material.

For the above applications, the bottom plate can be about six feet long (running along the length of the support member) and about four inches across the top flange of the member. However, the bottom plate can be any length and width based on the requirements of the roof system. The bottom plate can be made of any gauge (e.g., 22-18 gauge). The bottom plate can be made of mild-steel or AHSS depending on the uplift strength required. The AHSS metallurgy would allow the bottom plates to last longer than ones of mild-steel due to the AHSS abrasion-resistance properties. For new construction applications, the bottom plate can be configured to accomplish multiple functions of the construction process. The bottom plate can become a horizontal support member, a roof attachment system, a lighting system, an electrical conduit system and/or a fluid handling system.

The present invention allows metal panels to achieve high uplift ratings (e.g., above 300 mph) while housing ridged insulation, lighting, controls and electrical systems. The design of the U-Beam does not require metal welding of the components of the structural member. The invention is made from structural steel sheet formed into its unique U-shape.

The U-beam of the present invention has 4 areas: beam body, compartment area, closure plate, and internal supports.

The beam body is the main support structure of the U-beam. The beam body is formed from sheet metal in the shape of an inverted "U". The thickness of the sheet metal is based on the loads expected to be carried by the support member. The thickness of the sheet metal can be from 3 gauge to 18 gauge, preferably 14 or 16 gauge. To lighten the weight of the beam body for a given load, advance high strength steel (AHSS) can be used instead of mild steel.

Load requirements for a beam body increase as the span of the beam body (length of the beam) increases. As the load increases, the depth of the beam body increases. The U-shaped design allows for higher load ratings than current purlins, girts and joists. The U-shape can be achieved using a single sheet of metal or a combination of sheets attached to one another. High-strength glue and structural rivets can be used to bind the components together.

The section of the body that faces skyward when installed on the vertical support structure is called the top flange. The top flange area can be as narrow as 3 inches and as wide as 24 inches depending on the load requirements. The web of the U-beam provides side walls of the beam which represents the depths of the U-beam. The web can be as shallow as 4 inches and as deep as 60 inches as examples. The U-shaped design allows for ridged insulation such as polyisocyanurate to be inserted into the body of the structural member providing a uniform insulation layer. This uniform insulation layer lowers the amount of radiant heat transferred through the infrastructure support into the interior of the building when compared to conventional Z and C purlin systems. The section of the body that faces downward when installed on the vertical support structure is called the compartment area. An opening in the compartment area allows for housing of interior/exterior lighting, light-level sensors, security sensors, fire-detection sensors and electrical systems within the U-shaped structural member. All the electrical wiring for these items run inside of the beam body. This internal wiring eliminates the need to run electrical conduit across the ceiling to support the installation of the different fixtures. The compartment area can be any shape or size, but can be provided in standard and double wide configurations. The standard size compartment area can be sized to house smaller utility systems. The wide compartment area can be sized to house larger electrical lighting units and/or fluid delivery systems. The double compartment can be sized to isolate high voltage wiring from low voltage and DC systems.

A closure plate closes the opening of the "U". The closure plate can be made of 24-gauge sheet metal but can be made of any thickness. The closure plate can be the same thickness of the U-beam when added strength is needed to keep the beam web from flexing. When LED lights, sensors or security devices are installed in the U-beam, the closure plate provides a mounting surface for the recessed equipment and will utilize a wide variety of thickness of sheet metal. The support inserts prevent the U-beam from collapsing inwards during heavy loading of the U-beam. The inserts can be structurally attached (e.g., rivets or glue or both rivets/glue) to the inside portion of the "U" on the beam's webs. Additional attachment can be made through a 360-degree clip top plate. The support inserts can be made of mild steel or AHSS metal and any thickness based on the loading requirements of the U-beam.

2. Summary of the Various Embodiments of the Present Invention

The present invention provides a roof apparatus comprising of multiple supporting members as part of a building frame that can be purlins, channels, joists, U-beams or hat channels.

Clip assemblies on the beams each include a bottom member, a top member, and a sliding anchor.

Multiple roof panels each have an upper or ridge end portion and a lower end portion, wherein an edge portion of one the roof panel connects to and overlaps an edge portion of another roof panel.

Valley portions on each roof panel enable collection of rainwater and a channeling of the rainwater to each roof panel lower portion, each valley portion having a bottom.

A shear connection fastens each roof panel to the sliding anchor.

A panel cap can connect to the roof panel at the valley portion.

In one embodiment, a panel cap fitting occupies a valley portion. Fasteners connect the panel cap fitting to a valley portion.

In one embodiment a panel cap interlocks with a panel cap fitting.

In one embodiment, each roof panel has a planar upper surface and one or more offset portions at an edge. The offset portion is below the planar upper surface.

In one embodiment, a panel cap extends laterally to the offset portions.

In one embodiment, the sliding anchor is able to move in all directions relative to the top member. The top member has spaced apart openings and each valley portion connects to the sliding anchor at the top member opening.

In one embodiment, the shear connectors include fasteners that extend through a panel cap fitting, a roof panel, and a panel cap clip.

The shear connectors can include fasteners that extend through a panel cap fitting and a roof panel at a valley portion.

The present invention provides a roof apparatus that comprises of multiple supporting members and multiple roof panels that each have an upper portion, a lower portion and an edge portion of one roof panel that connects to an edge portion of another roof panel.

In one embodiment, a connection assembly or clip assembly forms an interface between the support members and roof panels.

In one embodiment, each roof panel has an upper planar section and one or more channels that extend below the upper planar section, wherein the upper planar section and channels are configured to channel and drain rainwater from the roof panels.

In one embodiment, a connection assembly or clip assembly includes a bottom member, a top member having spaced apart top member openings, and a sliding anchor that is movable in multiple directions relative to the top and bottom members. The roof panels connect to and move with the sliding anchors.

In one embodiment, one or more fittings connect the roof panels to the sliding anchors, each fitting extending through a top member opening.

In one embodiment, a panel cap connects to the roof panel at a channel portion.

In one embodiment, a panel cap fitting that occupies a valley portion and fasteners connect the panel cap fitting to a channel portion.

In one embodiment, each roof panel has a planar upper surface and one or more offset portions at a panel edge. The offset portion is below the planar upper surface.

In one embodiment, support members that support the roof panels can include purlins, joists, hat channels, and U-beams.

In one embodiment, the U-beam is comprised of a pair of spaced apart webs, a top flange connecting to the webs, a closure plate below the top flange that is connected to the webs and one or more internal supports, each having one or more vertically spaced apart apertures.

In one embodiment, the closure plate has a longitudinal slot or passageway.

In one embodiment, there is a stiffening flange on each bracket.

In one embodiment, each roof panel connects to the sliding anchor with multiple spaced apart shear clips.

In one embodiment, multiple bracket bridges are provided that each span from one valley portion to another valley portion.

In one embodiment, each valley portion has an U or V shape in a transverse cross section.

The present invention provides a roof apparatus having multiple supporting members or beams.

Multiple roof panels each have a top portion, a bottom portion, an edge portion of one roof panel connecting to an edge portion of another roof panel. The beams support the roof panels and a specially configured clip assembly that forms an interface between the beams and the roof panels. The clip assembly or interface enables roof panel movement in multiple directions such as when the roof panels expand or contract. The interface preferably includes a bottom member, a top member, a sliding anchor, a bracket and shear clips that connect the bracket to the sliding anchor.

A bracket preferably includes multiple bracket panels and multiple bracket valleys.

In one embodiment, each roof panel has an upper planar section and one or more channels that extend below the upper planar section, wherein the upper planar section and the channels are configured to channel and drain rainwater from the roof panels.

In one embodiment, the clip or connection assembly includes a bottom member, a top member having spaced apart top member openings and a sliding anchor that is movable in multiple directions relative to the top and bottom members. In one embodiment, one or more fittings connect the roof panels to the sliding anchors, each fitting extending through a top member opening.

In one embodiment, a roof apparatus comprising of multiple under support members or beams.

There are clip assemblies on the beams, each clip assembly including a bottom plate, a top plate having one or more spaced apart openings, a sliding anchor and a bracket with one or more downwardly projecting portions that each extend through a top plate opening. Multiple roof panels each have an upper portion, a lower portion and opposing edge portions, wherein an edge portion of one roof panel connects to and overlaps an edge portion of another roof panel.

In one embodiment, valley portions on each roof panel enable collection of rain water and a channeling of the rain water to each roof panel lower portion, each valley portion having a bottom.

In one embodiment, a shear connection fastens each roof panel to a sliding anchor.

In one embodiment, a panel cap that connects to the roof panel at a valley portion.

In one embodiment, a panel cap fitting occupies the valley portion and fasteners connect the panel cap fitting to the valley portion.

In one embodiment, the panel cap interlocks with the panel cap fitting.

In one embodiment, each roof panel has a planar upper surface and one or more offset portions at an edge that is below the planar upper surface.

In one embodiment, the panel cap extends laterally to the offset portions.

In one embodiment, the sliding anchor is able to move in multiple directions relative to the top and bottom plates.

In one embodiment, the top plate has spaced apart openings and each valley portion connects to the sliding member next to a top member opening.

In one embodiment, the shear connectors include fasteners that extend through a panel cap fitting, a bracket, and a roof panel.

In one embodiment, the shear connectors include fasteners that extend through a panel cap fitting and a roof panel at a valley portion.

The present invention provides a roof apparatus comprising of multiple supporting members that are part of a building frame. Multiple roof panels each have edge portions, an upper portion, a lower portion, wherein an edge portion of one the roof panel connects to an edge portion of another roof panel.

A connection or clip assembly preferably forms an interface between the support members and roof panels. The clip assembly preferably enables the roof panels to move in multiple directions (e.g., 360 degrees) relative to the supporting members;

The connection or clip assembly preferably includes a bottom member, a top member having spaced apart top member openings, a sliding anchor that is movable in multiple directions relative to the top and bottom members and a specially configured bracket that connects to the sliding anchor with a fitting.

In one embodiment, a panel cap connects to the roof panel at a channel portion.

In one embodiment, a panel cap fitting occupies the valley portion and fasteners that connect the panel cap fitting to the channel portion.

In one embodiment, each roof panel has a planar upper surface and one or more offset portions at an edge, each offset portion located below the planar upper surface.

In one embodiment, the sliding anchor and roof panels are able to move in all directions relative to the top member.

In one embodiment, each support member can be any suitable beam such as a purlin, joist, hat channel, and U-beam.

In one embodiment, the U-beam is comprised of a pair of spaced apart webs, at top flange connecting to the webs, a closure plate below the top flange that is connected to the webs and one or more interval supports having one or more vertically spaced apart apertures. In one embodiment, the closure plate has a longitudinal slot.

In one embodiment, each roof panel connects to the sliding anchor with multiple spaced apart shear clips.

In one embodiment, multiple bracket bridges each span from one valley portion to another valley portion. Each valley portion has a U or V shape in transverse cross section.

In one embodiment, each bottom member has a flange with a bend portion that extends laterally away from the bottom member.

In one embodiment, a specially configured U-beam having opposed parallel webs, a top flange, a bottom portion and spaced apart reinforcing panels that span between the webs. The U-beam preferably has a longitudinally extending cavity that enables carriage of piping, electrical lines, or other wiring or utilities.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 47 is a fragmentary perspective view of a preferred embodiment of the apparatus of the present invention showing the shear clip slide assembly;

FIG. 48 is a fragmentary planar view of a preferred embodiment of the apparatus of the present invention showing the shear clip slide assembly;

FIG. 49 is a fragmentary elevation view of a preferred embodiment of the apparatus of the present invention showing the shear clip slide assembly;

FIG. 50 is a fragmentary perspective view of a preferred embodiment of the apparatus of the present invention showing the shear clip;

FIG. 51 is a fragmentary perspective view of a preferred embodiment of the apparatus of the present invention showing the shear clip;

DETAILED DESCRIPTION OF THE INVENTION

Figure 1:
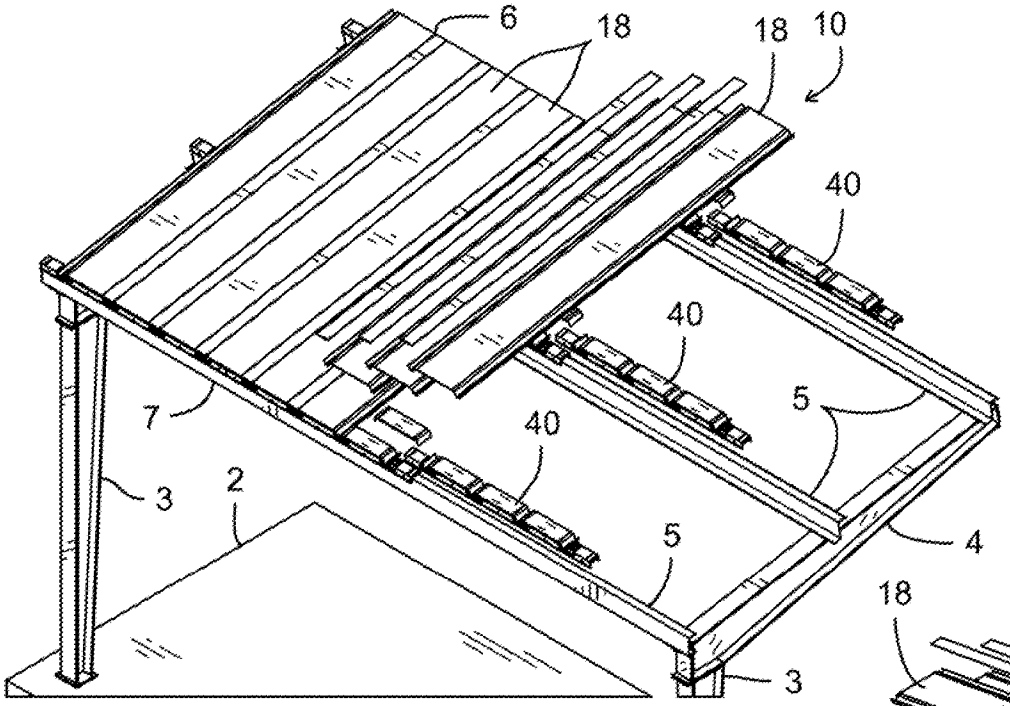
FIGS. 1-2 are schematic views of a metal building fitted with a roof apparatus of the present invention.
Figure 2:
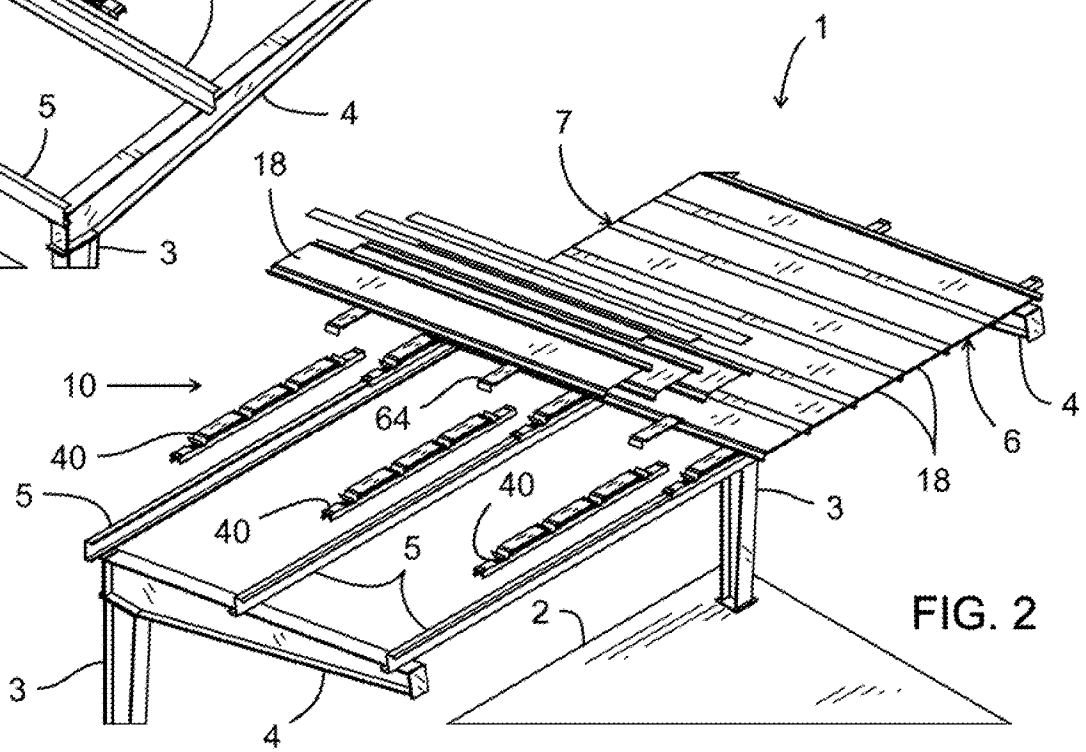
Figure 13:
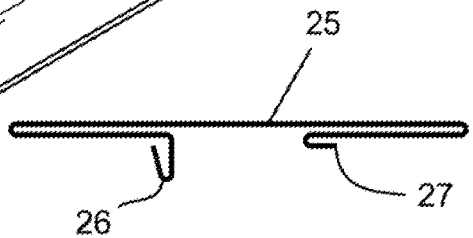
FIG. 13 is a fragmentary end view of a preferred embodiment of the apparatus of the present invention showing the panel cap with offset.
Figure 14:
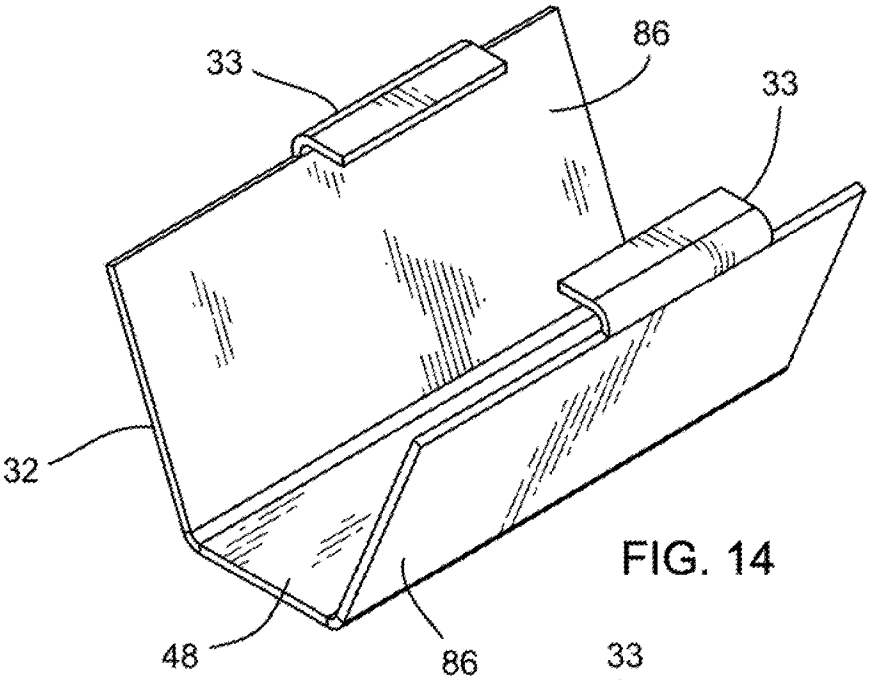
FIG. 14 is a fragmentary perspective view of a preferred embodiment of the apparatus of the present invention showing panel cap clip.
Figure 17:
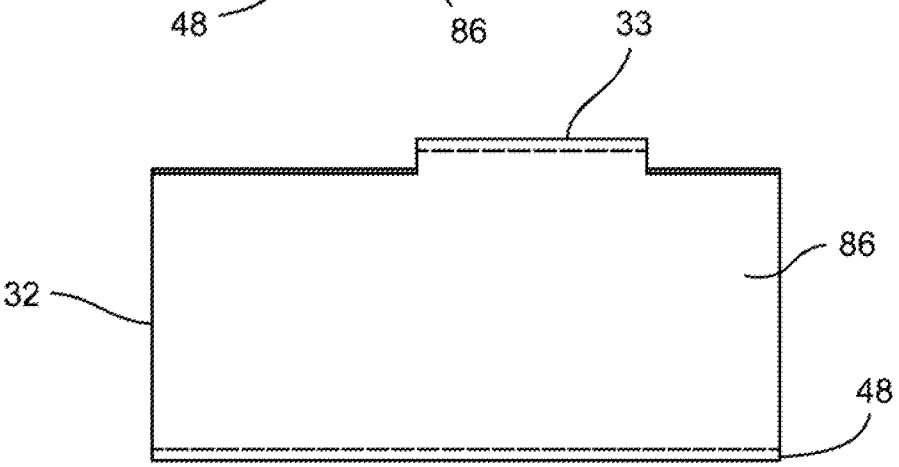
FIG. 17 is a fragmentary side view of a preferred embodiment of the apparatus of the present invention showing panel cap clip.
Figure 16:
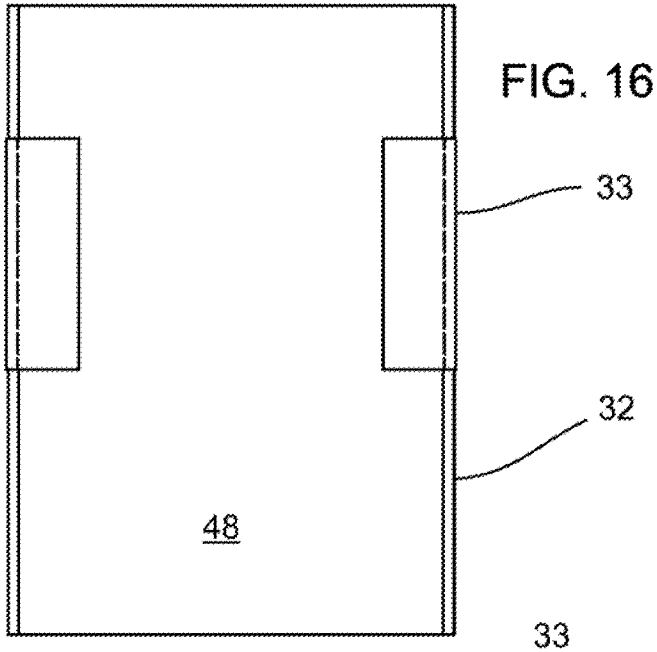
FIG. 16 is a fragmentary top view of a preferred embodiment of the apparatus of the present invention showing panel cap clip.
Figure 15:
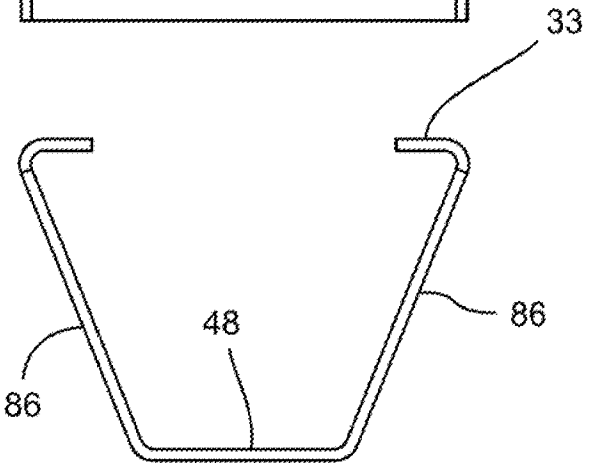
FIG. 15 is a fragmentary end view of a preferred embodiment of the apparatus of the present invention showing panel cap clip.

FIGS. 1-2 show a schematic view of a metal building/ fitted with roof apparatus 10 of the present invention. Building 1 has a slab (or like foundation) 2 supporting a building frame that includes a selected number of vertical members or columns 3, inclined members 4 and beams 5. The vertical members or columns 3 support inclined members 4. Inclined members 4 support multiple beams 5 such as purlins 11, C-channels 19, hat channels 16 or U-beams 65-67. The beams 5 support multiple roof panels 18 using a specially configured clip assembly or interface 40. Roof panels 18 can be inverted panels 21 with offset portions 24 (see FIGS. 3, 5, 8-9, 18, 21, 24, 27) or inverted panels 28 having no offset portion (see FIGS. 6-7, 19, 22, 25). Roof panels 21, 28 can have ribs 22 or 29 that provide water conveying channels 35 (e.g., V or U shape). In one embodiment, a panel cap 25 (FIG. 13) or 31 (FIG. 11) can cover each water channel 35.

Figure 28:
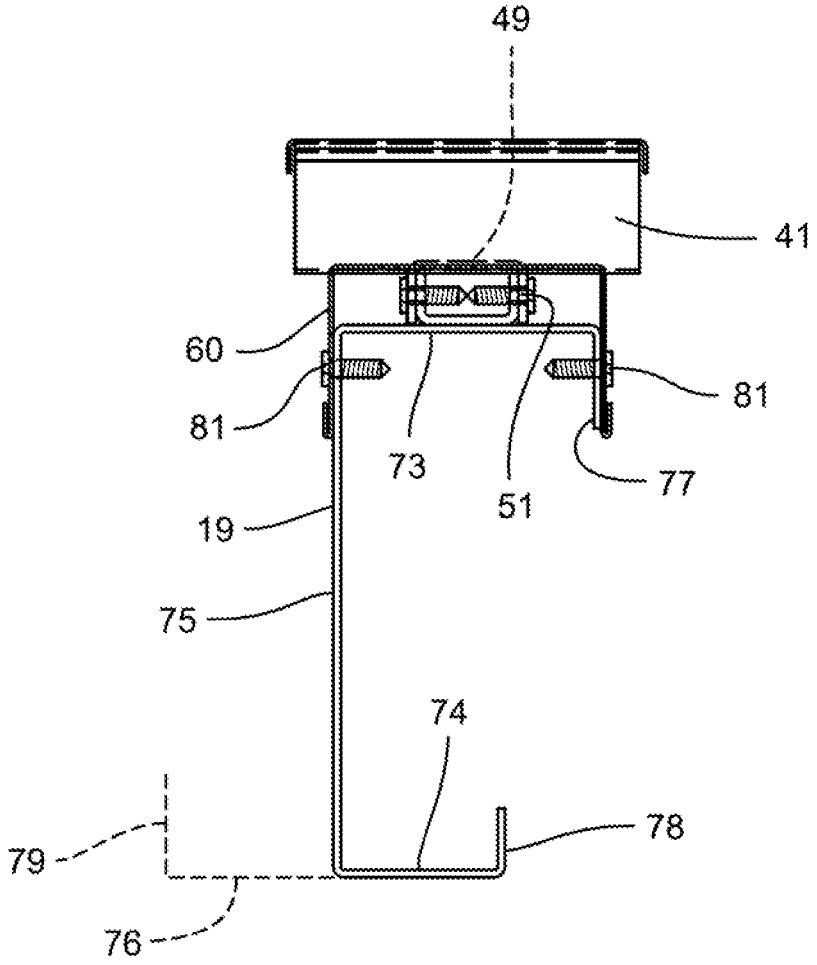
FIG. 28 is an end view of a preferred embodiment of the apparatus of the present invention with the bottom plate in the form of a C-channel beam or in the form of a Z-channel beam as shown by the dotted line of the bottom flange.
Figure 29:
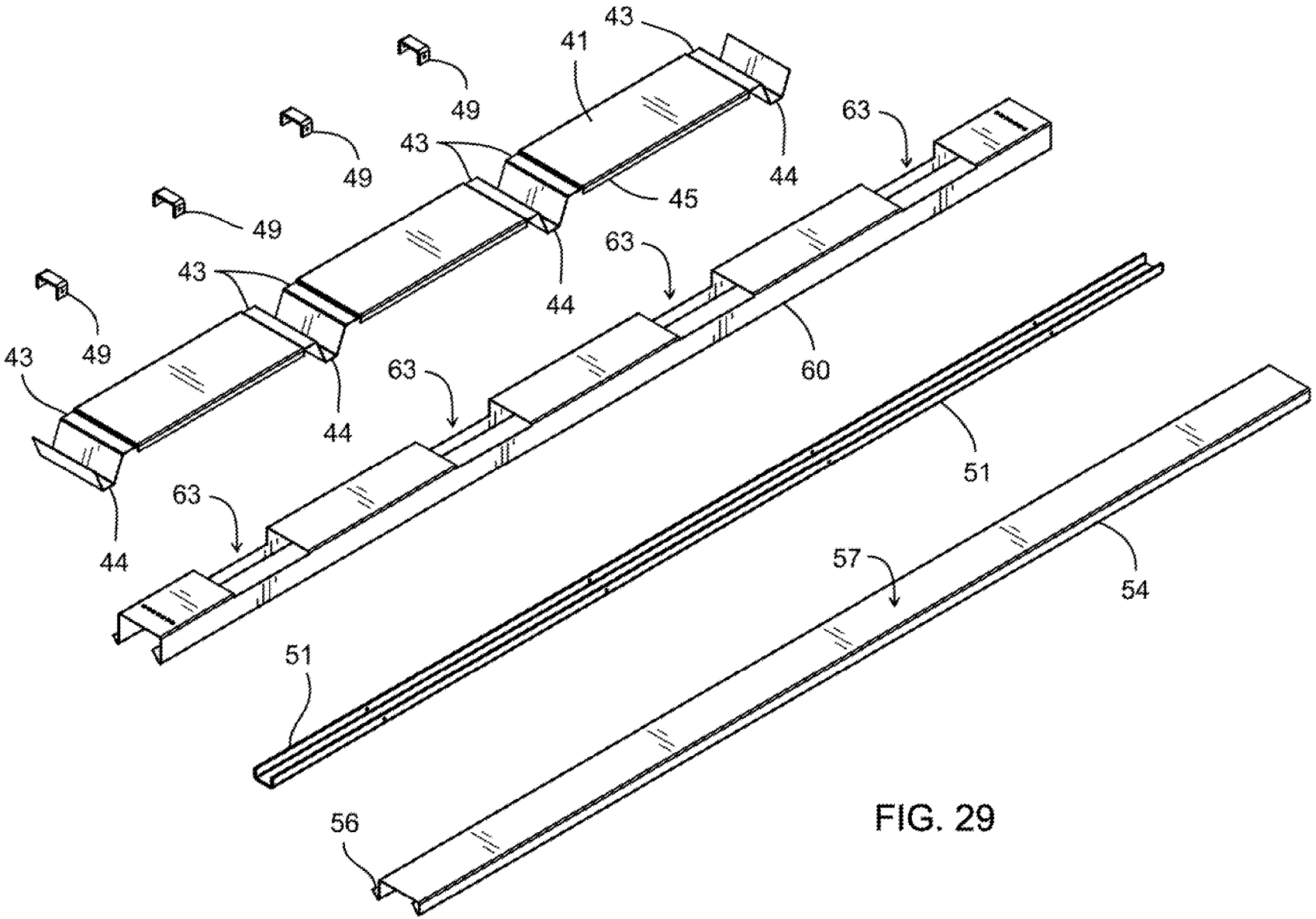
FIG. 29 is a perspective exploded view of a preferred embodiment of the apparatus of the present invention showing the anchor clip assembly.
Figures 30, 31, 32, 33, 34:
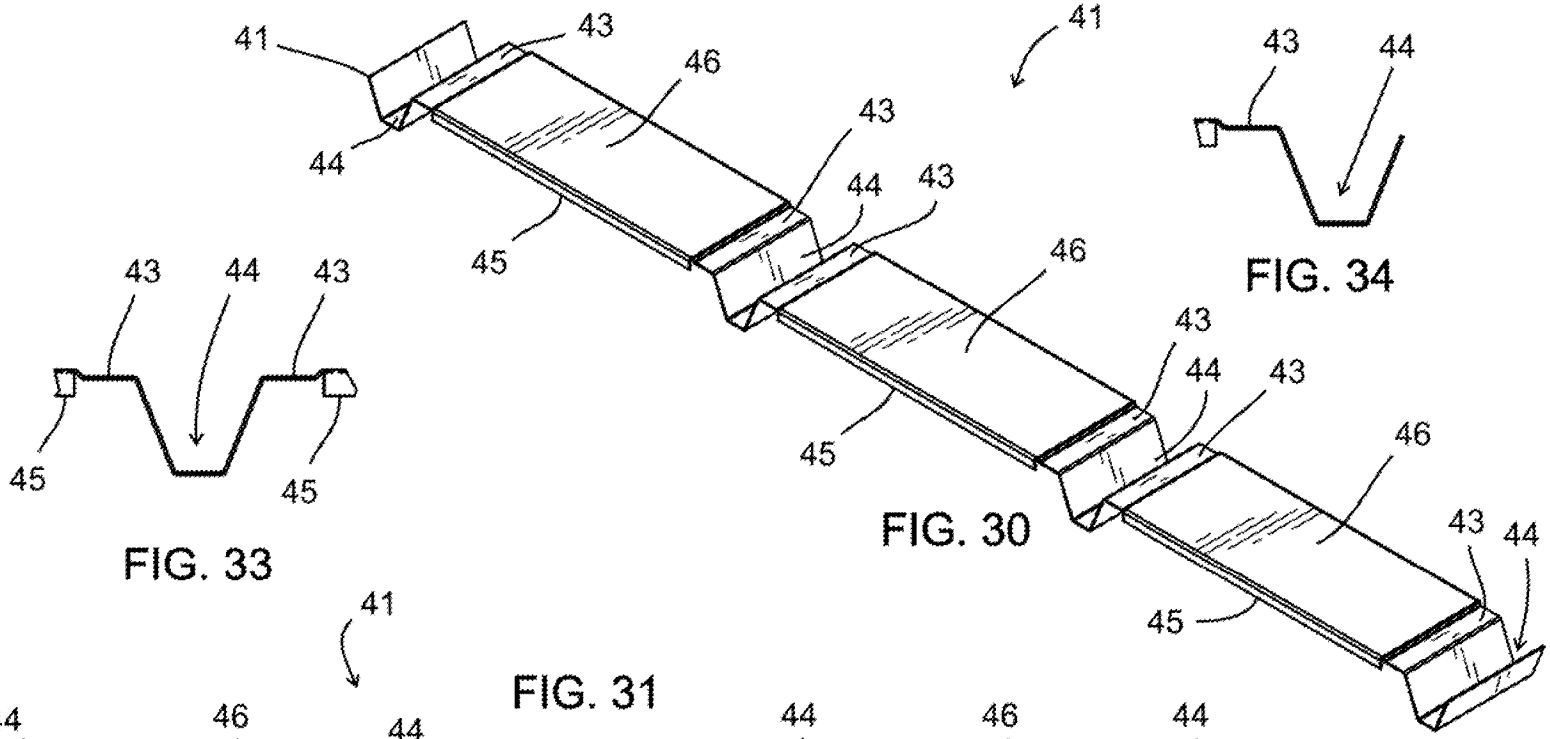
FIG. 30 is a partial perspective view of a preferred embodiment of the apparatus of the present invention showing bracket with offset portion.
FIG. 31 is a partial side view of a preferred embodiment of the apparatus of the present invention showing bracket with offset portion.
FIG. 32 is a partial top view of a preferred embodiment of the apparatus of the present invention showing bracket with offset portion.
FIG. 33 is a fragmentary end view of a preferred embodiment of the apparatus of the present invention showing bracket with offset portion.
FIG. 34 is a fragmentary end view of a preferred embodiment of the apparatus of the present invention showing bracket with offset portion.
Figures 35, 36, 37, 38, 39:
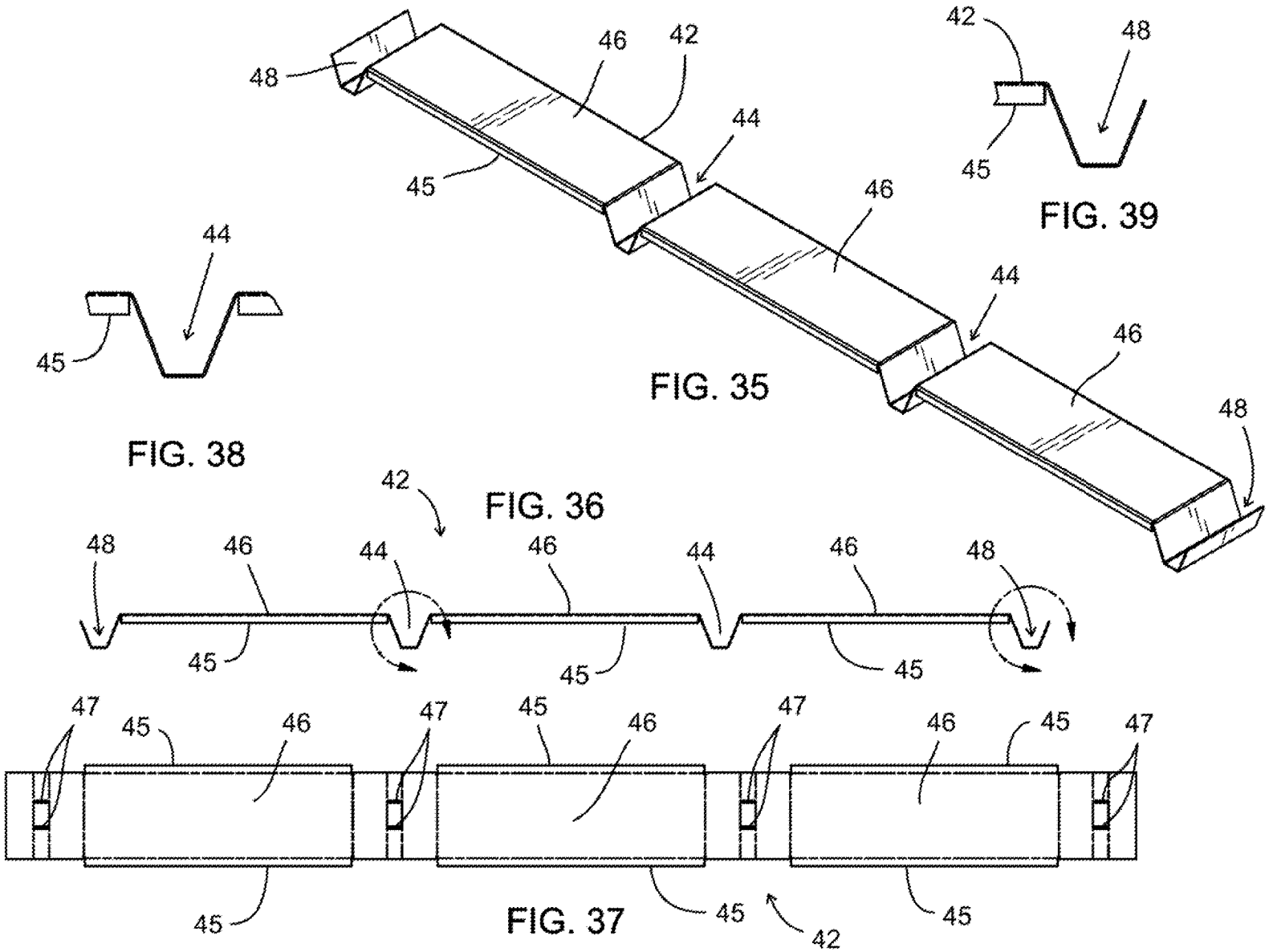
FIG. 35 is a partial perspective view of a preferred embodiment of the apparatus of the present invention showing bracket with no offset portion.
FIG. 36 is a partial side view of a preferred embodiment of the apparatus of the present invention showing bracket with no offset portion.
FIG. 37 is a partial top view of a preferred embodiment of the apparatus of the present invention showing bracket with no offset portion.
FIG. 38 is a fragmentary end view of a preferred embodiment of the apparatus of the present invention showing bracket with no offset portion.
FIG. 39 is a fragmentary end view of a preferred embodiment of the apparatus of the present invention showing bracket with no offset portion.
Figure 40:
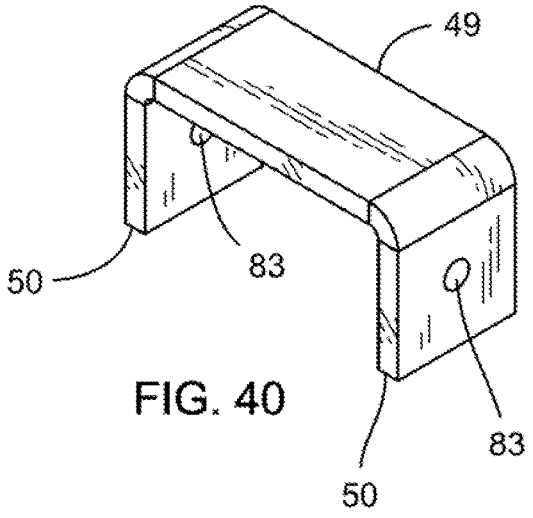
FIG. 40 is a fragmentary perspective view of a preferred embodiment of the apparatus of the present invention showing the shear clip.
Figure 41:
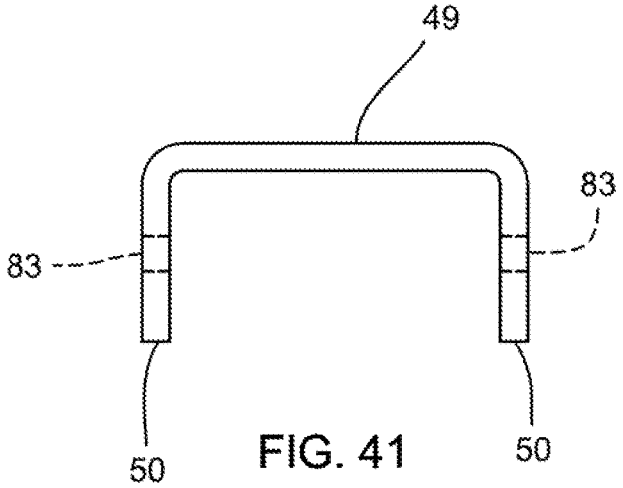
FIG. 41 is a fragmentary end view of a preferred embodiment of the apparatus of the present invention showing the shear clip.
Figure 42:
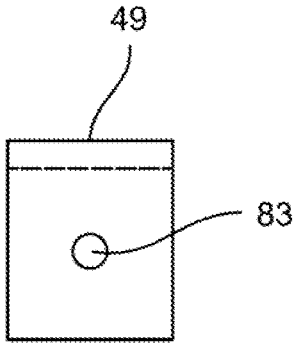
FIG. 42 is a fragmentary side view of a preferred embodiment of the apparatus of the present invention showing the shear clip.
Figure 44:
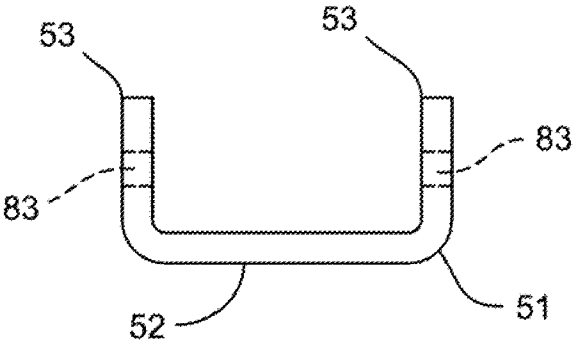
FIG. 44 is a fragmentary end view of a preferred embodiment of the apparatus of the present invention showing the sliding anchor.
Figure 43:
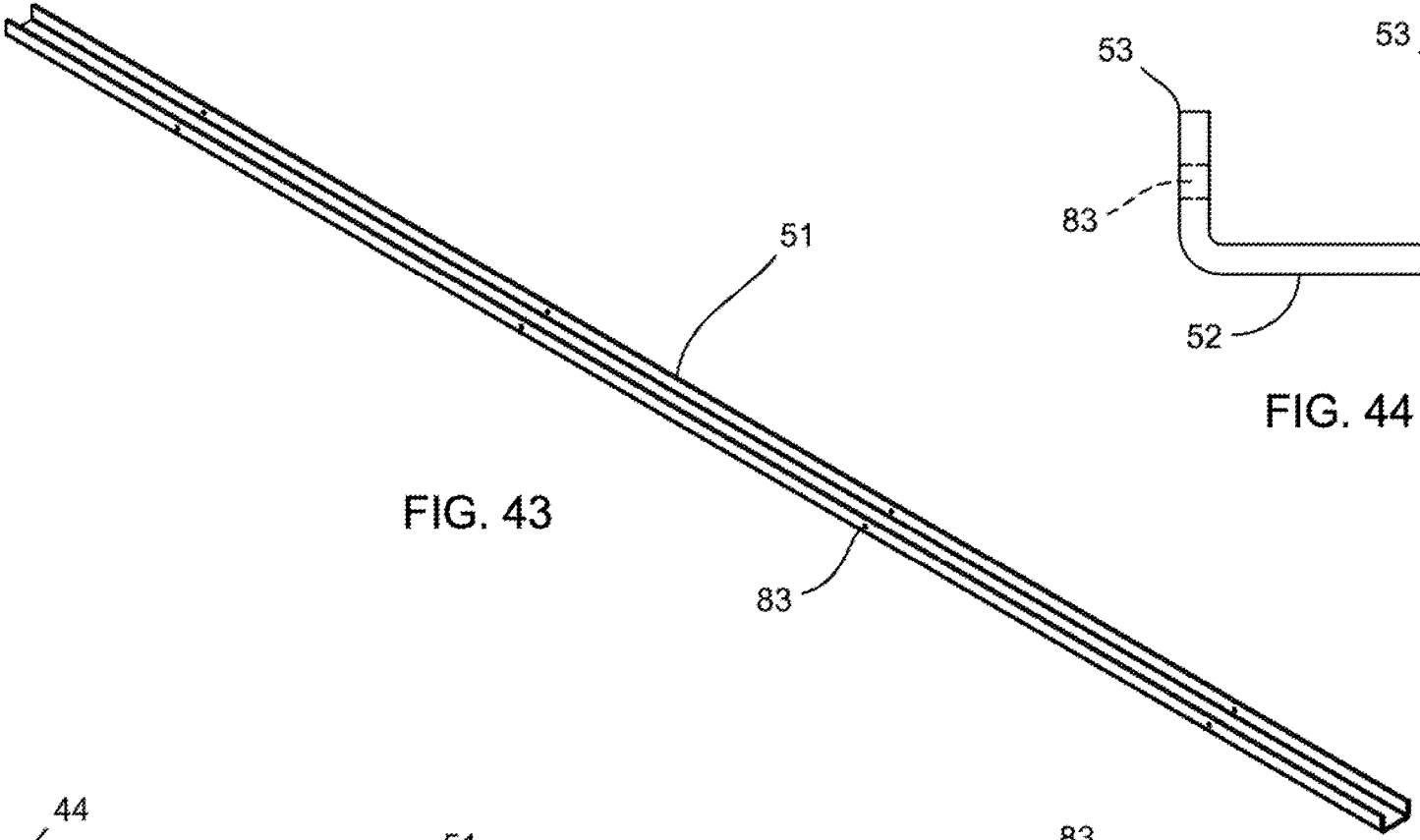
FIG. 43 is a fragmentary perspective view of a preferred embodiment of the apparatus of the present invention showing the sliding anchor.
Figure 45:
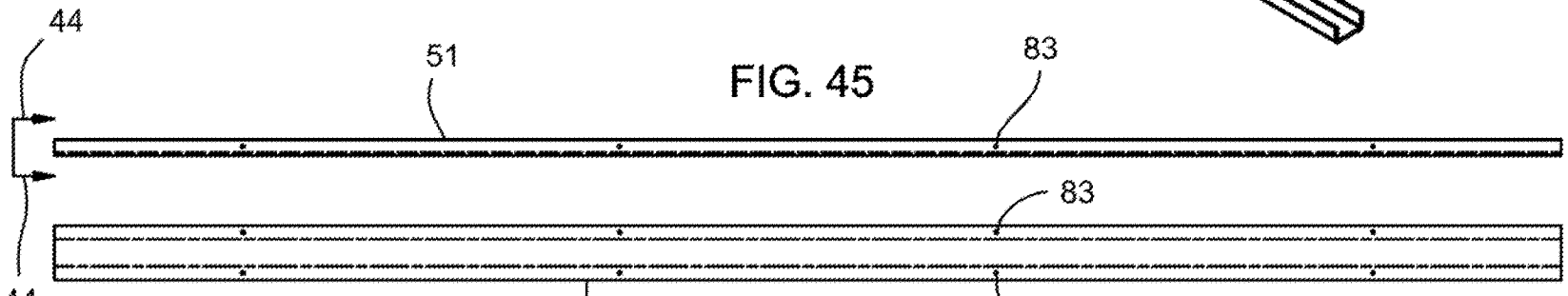
FIG. 45 is a fragmentary side view of a preferred embodiment of the apparatus of the present invention showing the sliding anchor.
Figure 46:
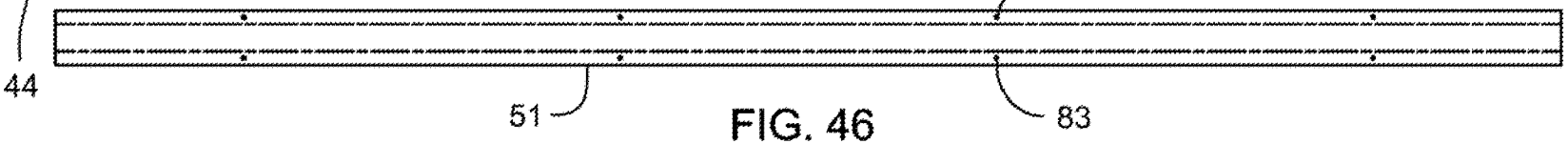
FIG. 46 is a fragmentary flat pattern top view of a preferred embodiment of the apparatus of the present invention showing the sliding anchor.

FIGS. 1-4 show the preferred embodiment of the apparatus of the present invention designated generally by the numeral 10. Roof apparatus 10 can be supported by multiple underlying beams 5. Beams 5 can be purlins 11, web joists 12, hat channel beams 16, C-channel beams 19 or U-beams 65-67. An anchor clip assembly or interface 40 (see FIGS. 1-5, 18-29, 47-51) forms a connection between beams 5 and roof panels 18. In FIG. 29, anchor clip assembly 40 includes bottom plate 54, sliding anchor 51, top plate 60, bracket 41 (or 42) and shear clips 49. The anchor clip assembly or interface 40 enables movement of the roof panels 18 in multiple directions (e.g., multi-directional or 360 degrees). This interface or anchor clip assembly 40 thus allows roof panel movement that is responsive to expansion and contraction as typically occurs multiple times each day (e.g., with rising and setting of the sun). The anchor clip assembly or interface 40 also provides a shear type connection that is stronger than prior art "pull out" type connections. For example, in FIG. 52 fasteners 80 would need to be sheared in order to lift or peel panel 21 from sliding anchor 51.

Figure 3:
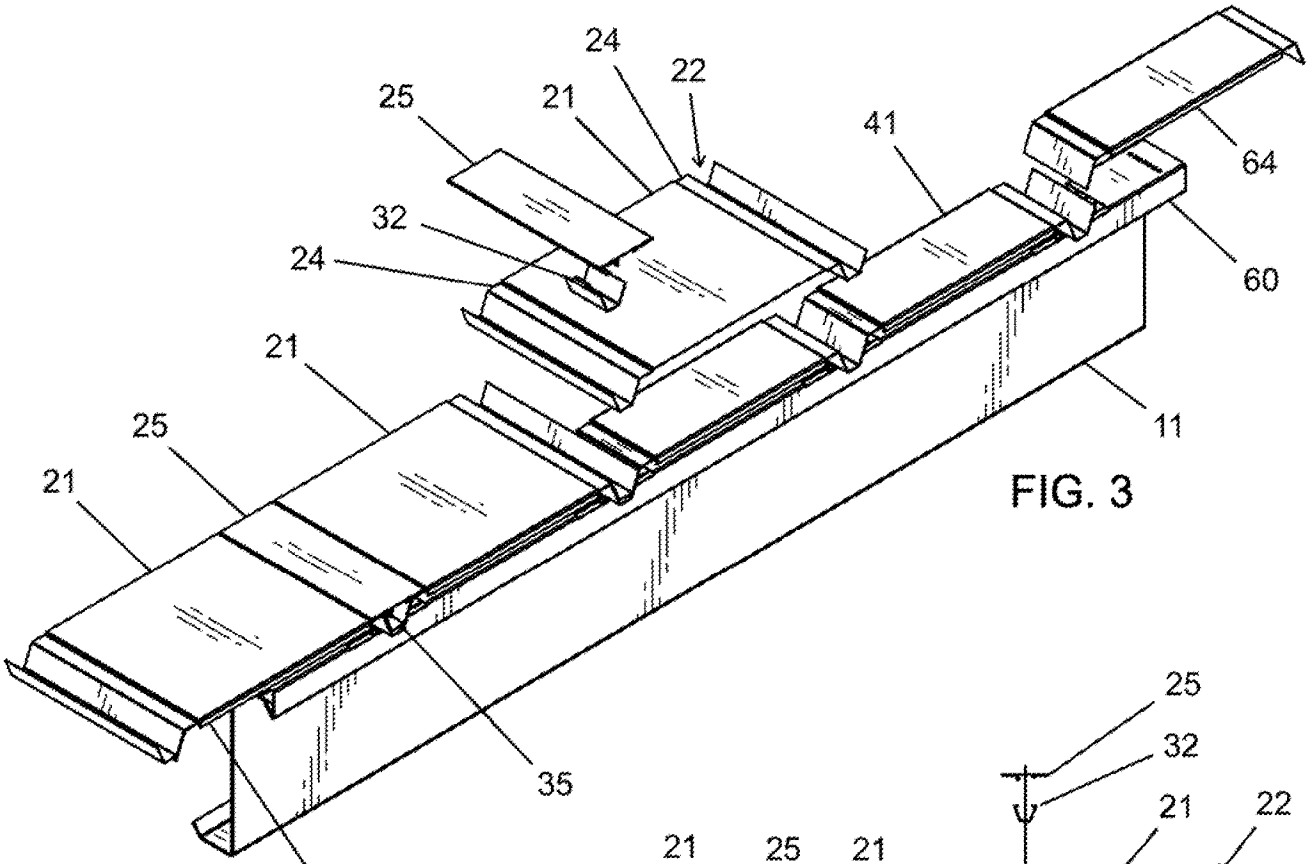
FIG. 3 is a perspective view of a preferred embodiment of the apparatus of the present invention.
Figure 18:
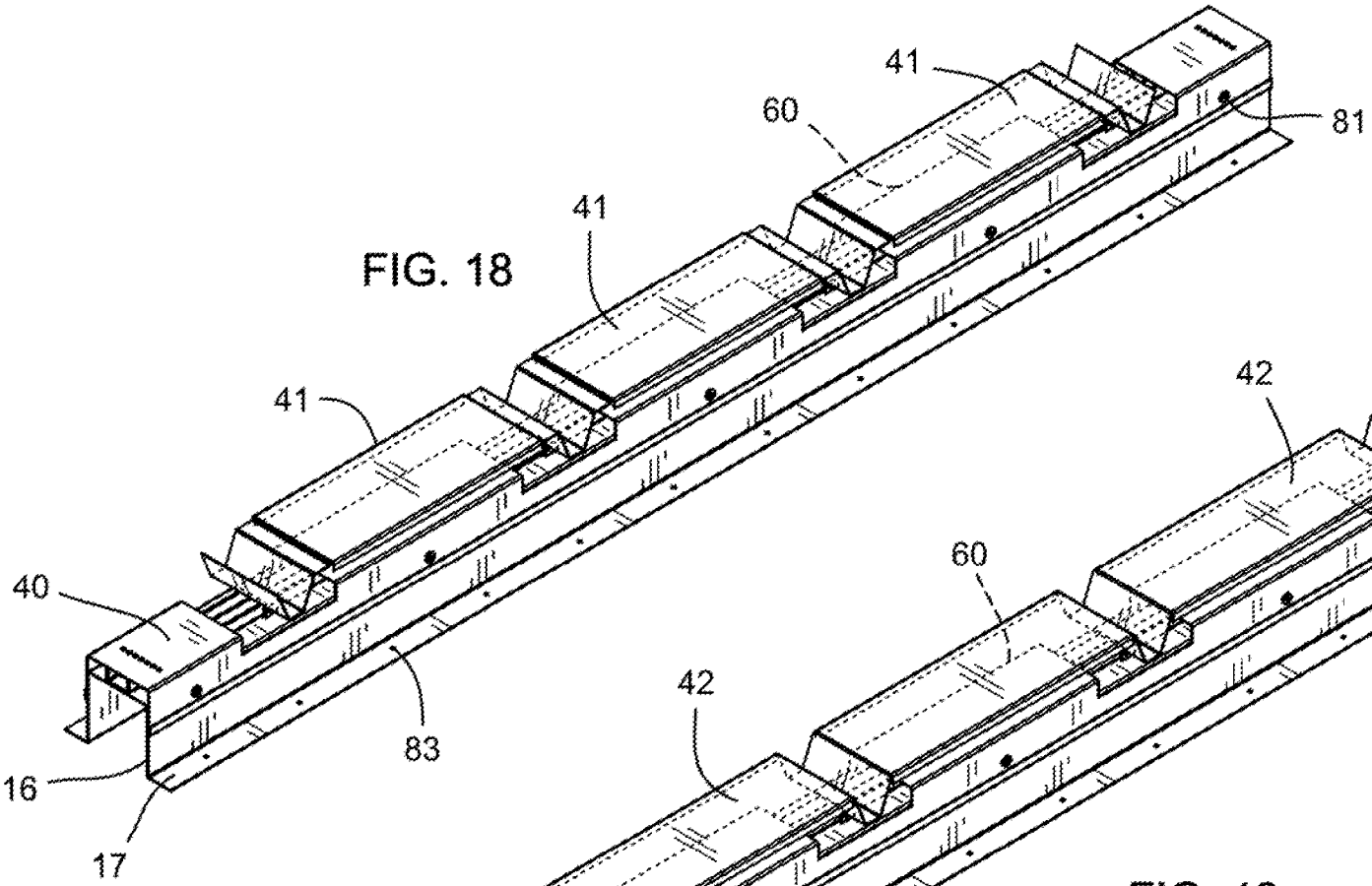
FIGS. 18-19 are perspective views of a preferred embodiment of the apparatus of the present invention on a hat channel beam.
Figure 19:
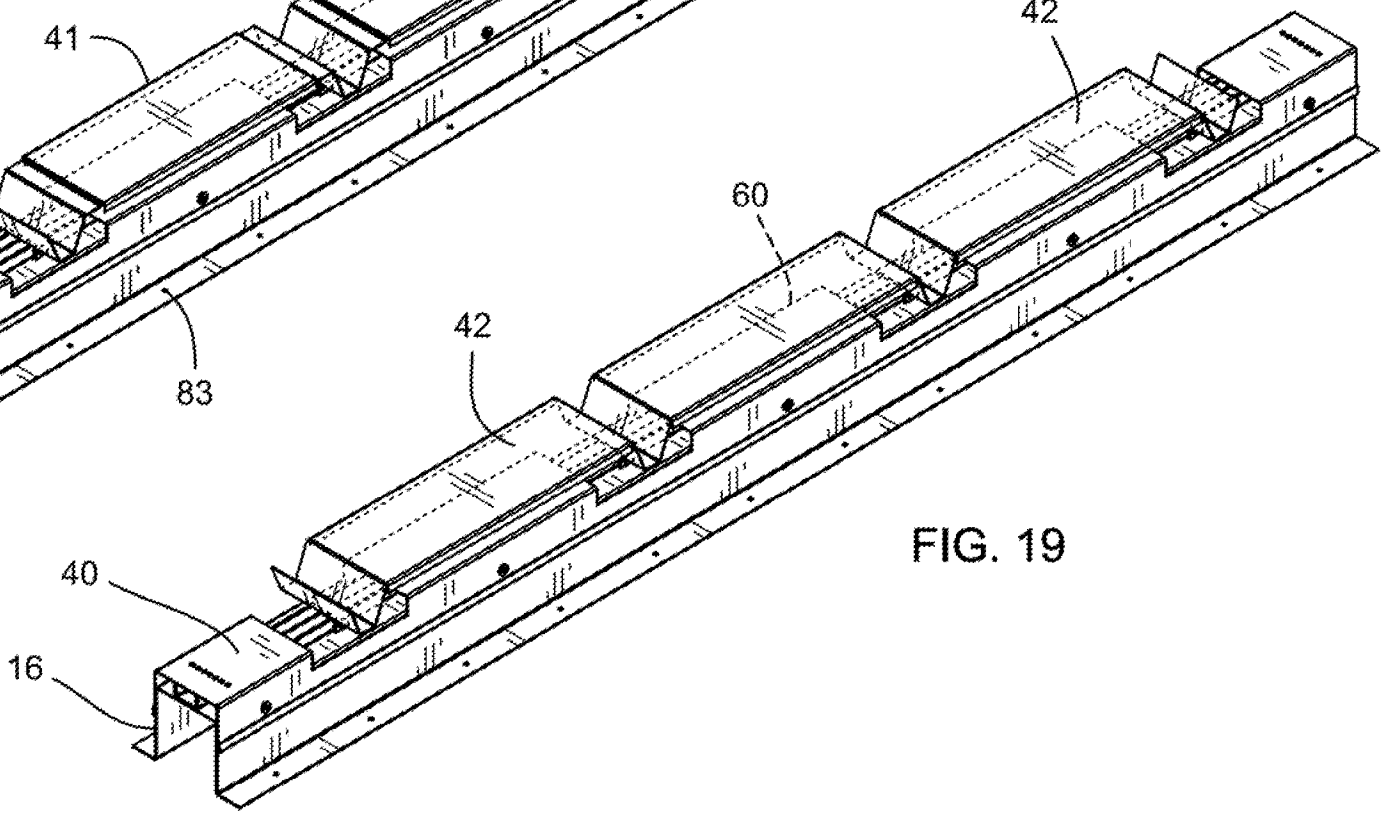
Figure 20:
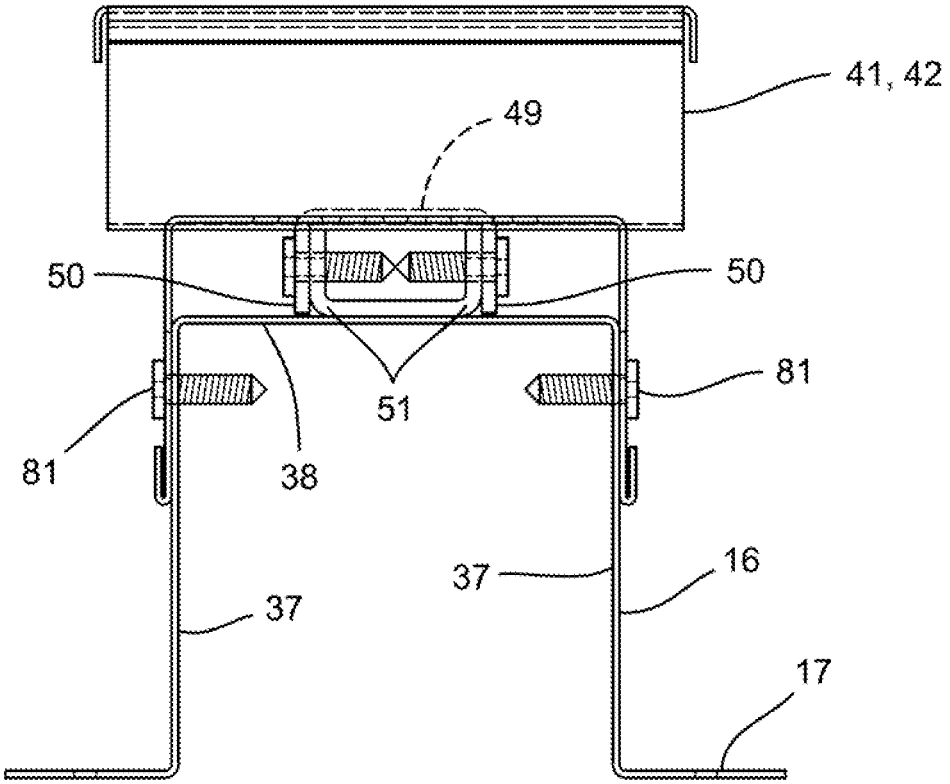
FIG. 20 is an end view of a preferred embodiment of the apparatus of the present invention with the bottom plate in the form of a hat channel beam.
Figures 21, 22:
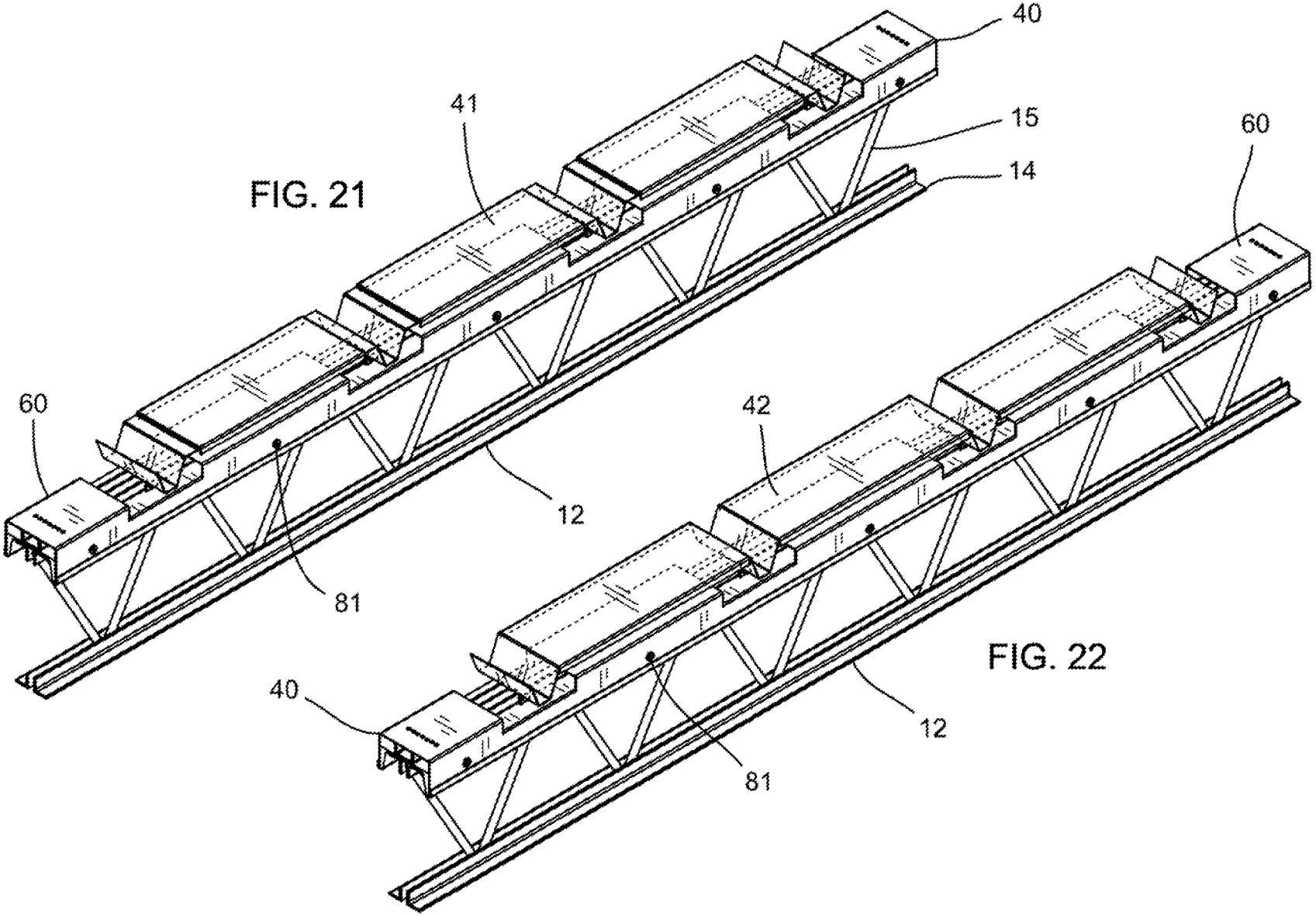
FIGS. 21-22 are perspective views of a preferred embodiment of the apparatus of the present invention on a web joist beam.
Figure 23:
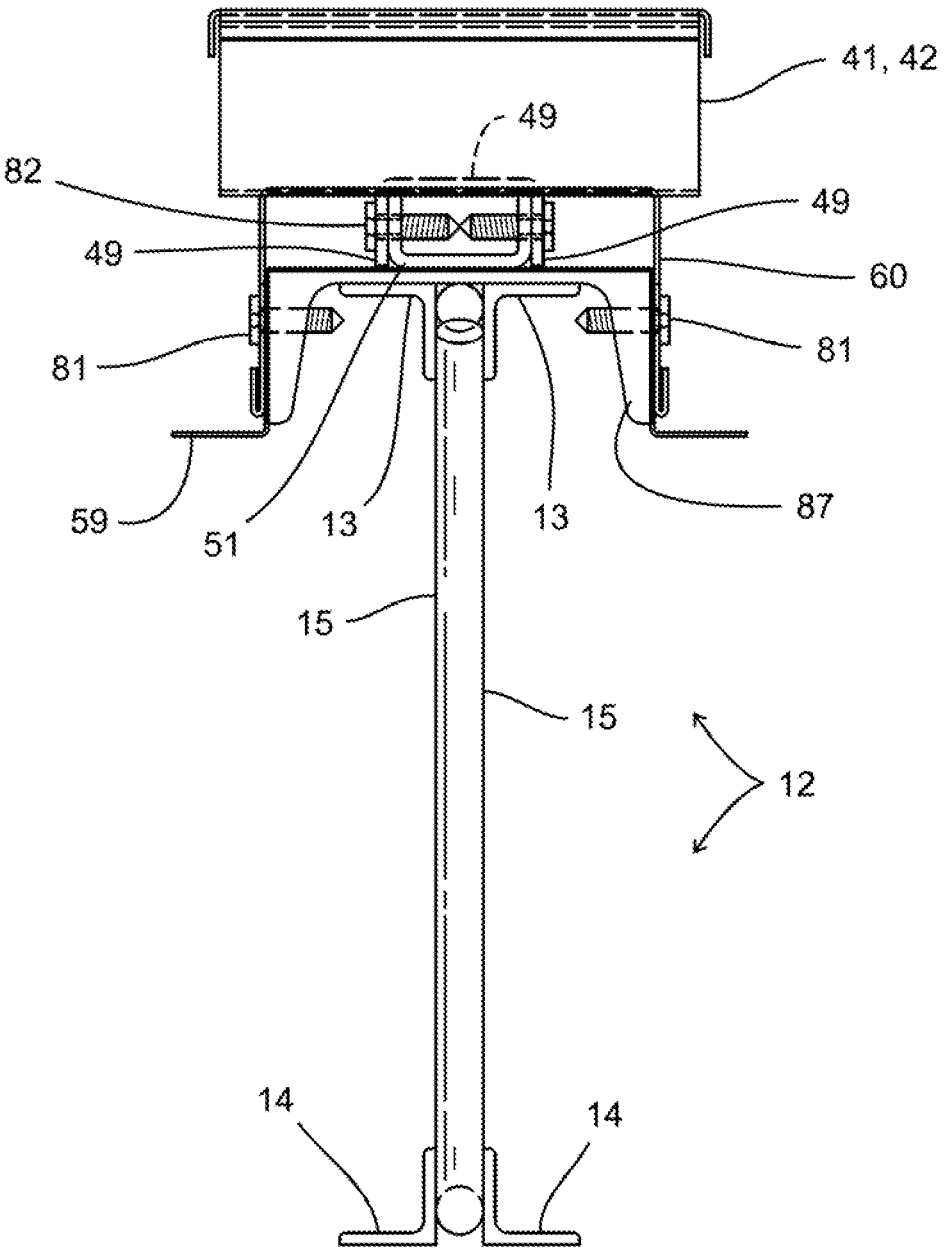
FIG. 23 is an end view of a preferred embodiment of the apparatus of the present invention on a web joist beam.
Figures 24, 25:
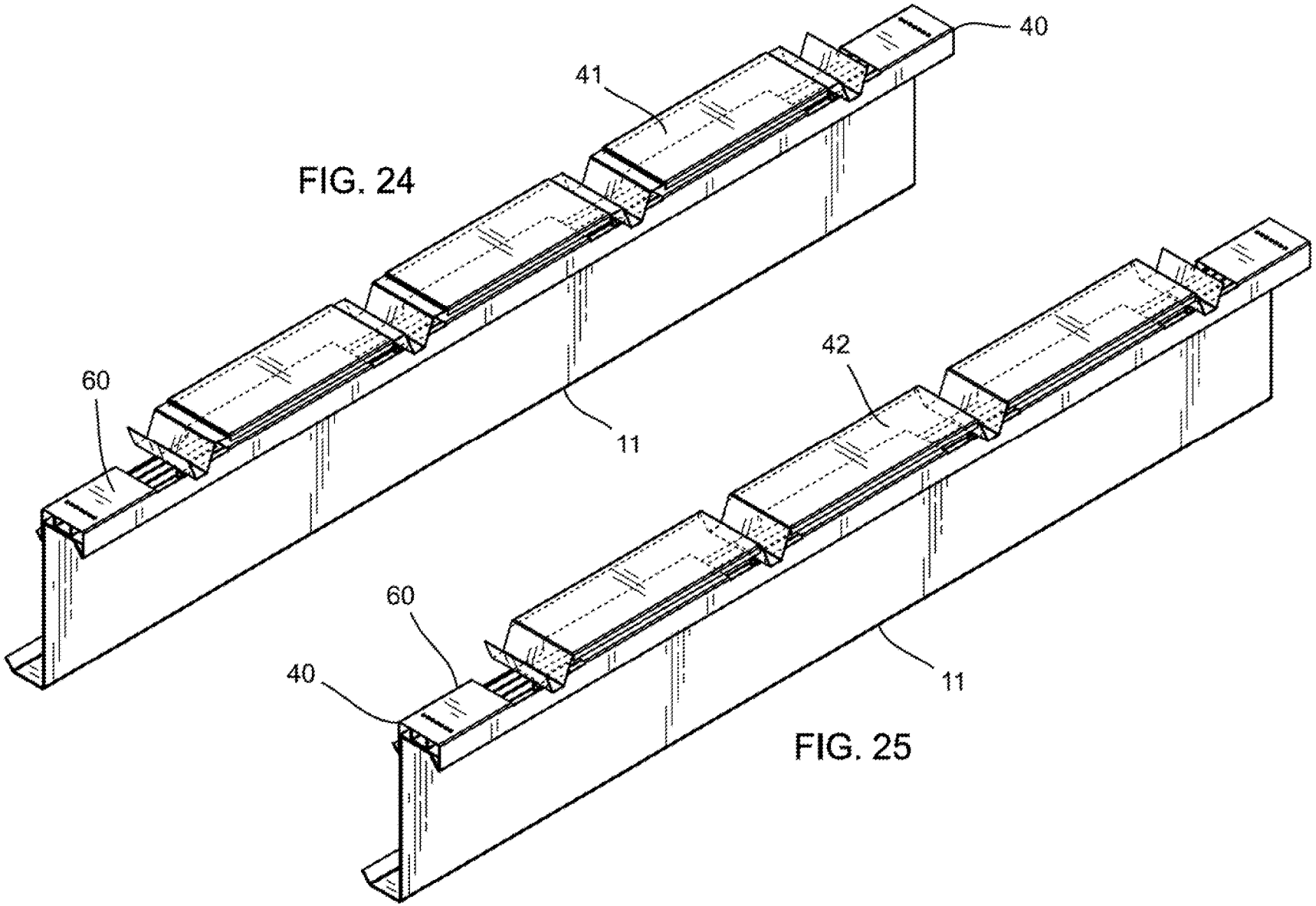
FIGS. 24-25 are perspective views of a preferred embodiment of the apparatus of the present invention on a purlin beam.
Figure 26:
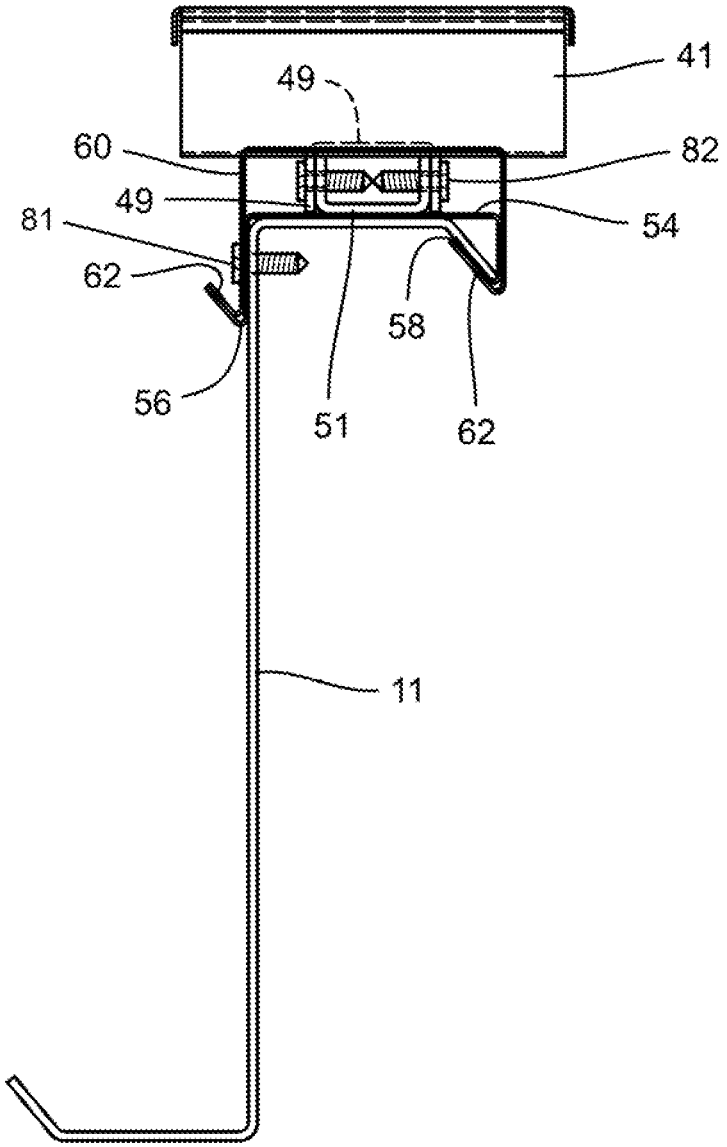
FIG. 26 is an end view of a preferred embodiment of the apparatus of the present invention on a purlin beam.
Figure 27:
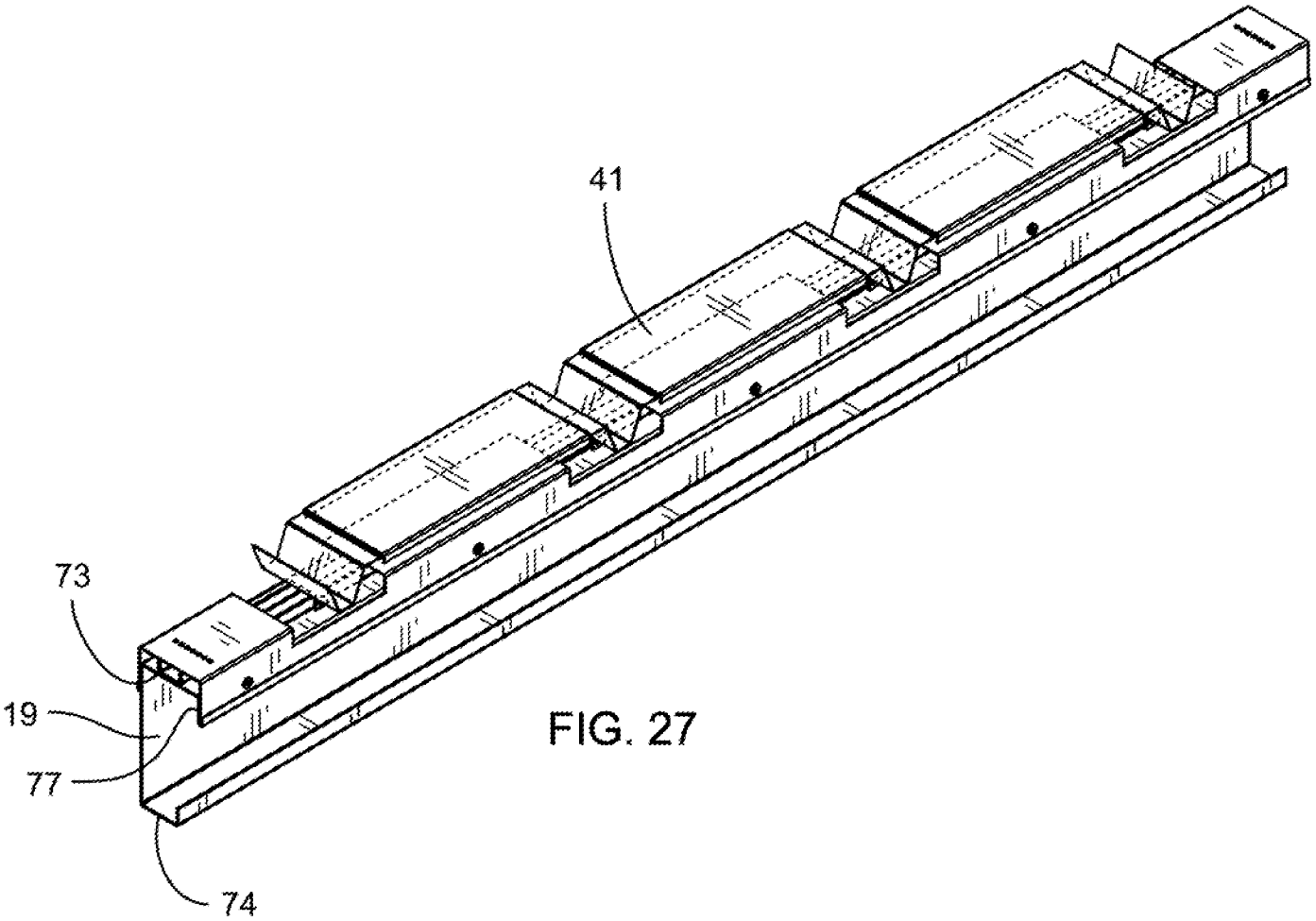
FIG. 27 is a perspective view of a preferred embodiment of the apparatus of the present invention with the bottom plate in the form of a C-channel beam or C purlin.
Figure 69:
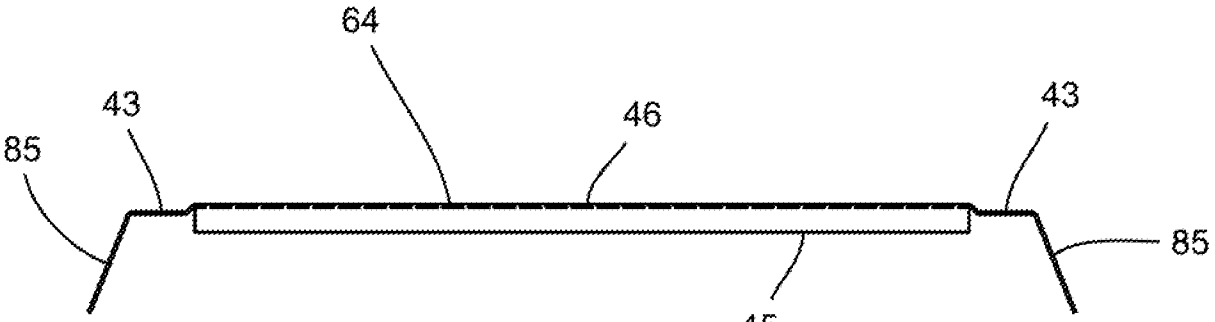
FIG. 69 is an elevation view of the preferred embodiment of the apparatus of the present invention showing the bracket bridge.

FIGS. 3-69 show the apparatus 10 of the present invention in more detail. In FIGS. 3-5, 24-26 and 52, the supporting beam 5 is a purlin 11 (e.g., Z purlin). In FIGS. 18-20, the supporting beam 5 is a hat channel 16. In FIGS. 21-23 the supporting beam 5 is a web joist 12. In FIGS. 27-28, the supporting beam 5 is a channel or C-channel 19. The roof panel 18 can be an inverted panel 21 with offset portion 24 as seen in FIGS. 3-5 and 8-9. Panel 21 has panel pan or planar section 23, ribs 22 and water conveying channels 35. The roof panel 18 can be an inverted roof panel 28 with no offset portion as seen in FIGS. 6-7, 19, 22 and 25. Roof panel 28 can have pan or planar section 30 and ribs 29, each rib 29 providing a water channel 35.

Figure 4:
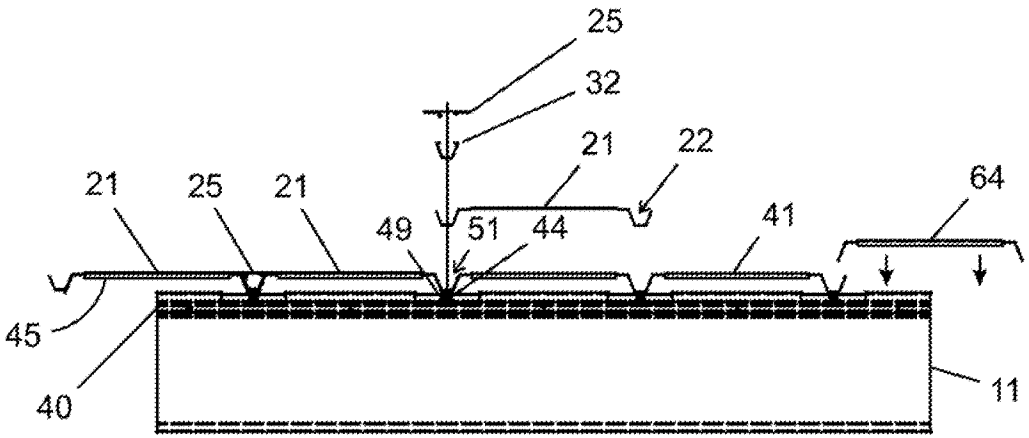
FIG. 4 is a partial section elevation view of a preferred embodiment of the apparatus of the present invention.
Figure 5:
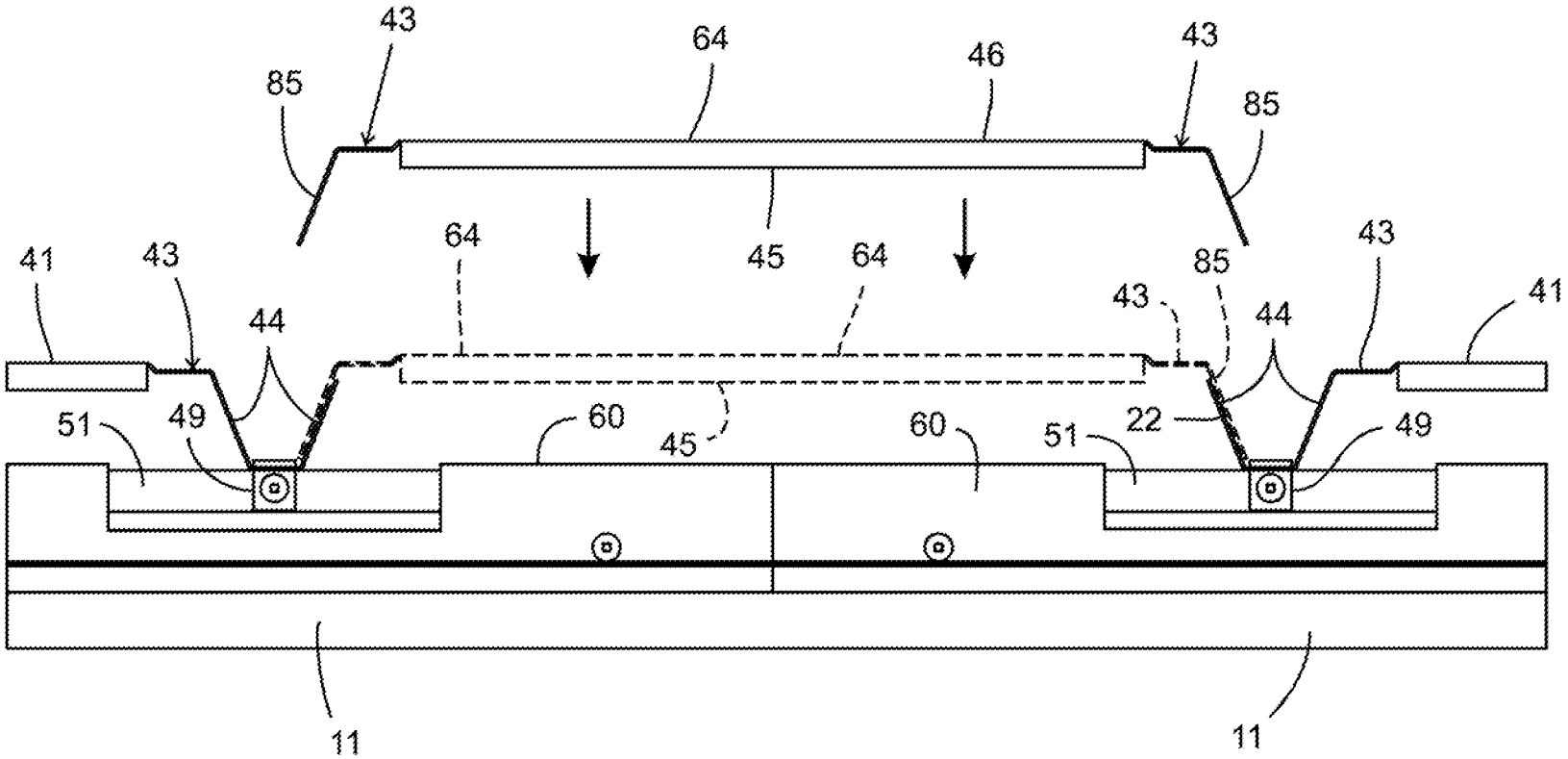
FIG. 5 is a partial sectional elevation view of a preferred embodiment of the apparatus of the present invention.
Figure 6:
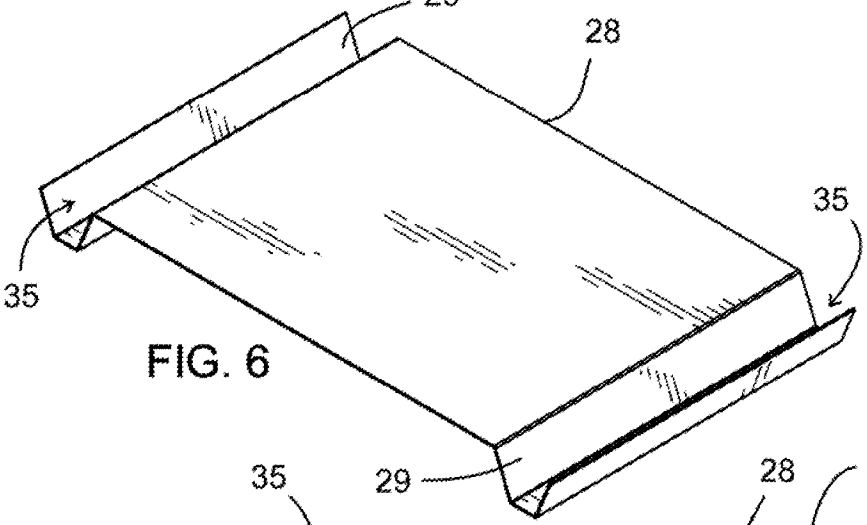
FIG. 6 is a fragmentary perspective view of a preferred embodiment of the apparatus of the present invention showing an inverted panel with no offset.
Figure 7:
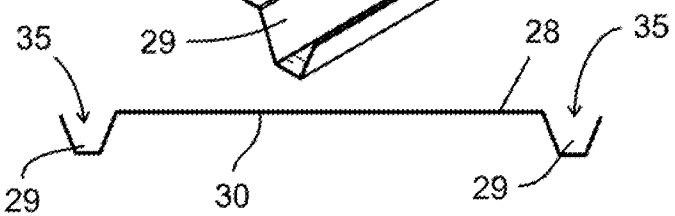
FIG. 7 is a fragmentary end view of a preferred embodiment of the apparatus of the present invention showing an inverted panel with no offset.
Figure 8:
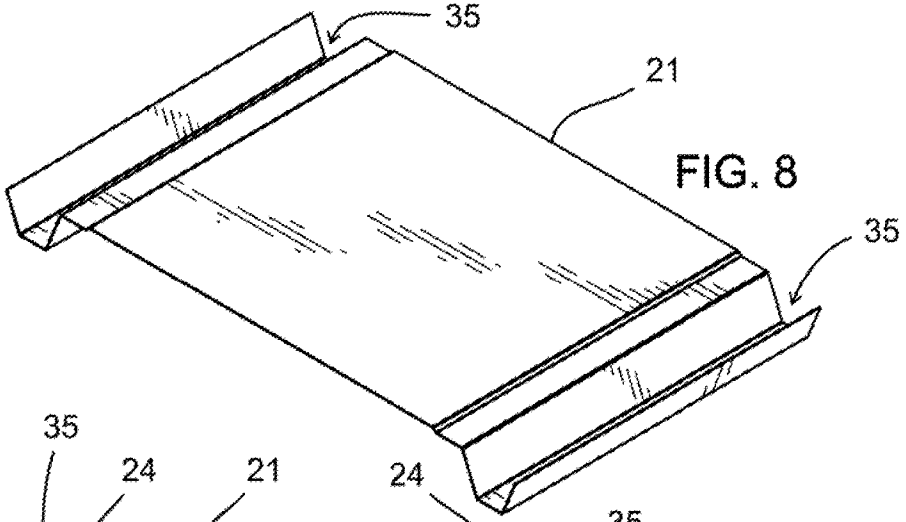
FIG. 8 is a fragmentary perspective view of a preferred embodiment of the apparatus of the present invention showing an inverted panel with offset.
Figure 9:
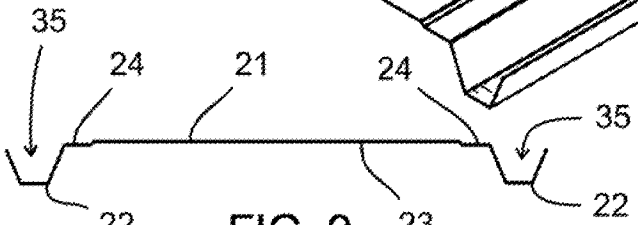
FIG. 9 is a fragmentary end view of a preferred embodiment of the apparatus of the present invention showing an inverted panel with offset.
Figure 12:
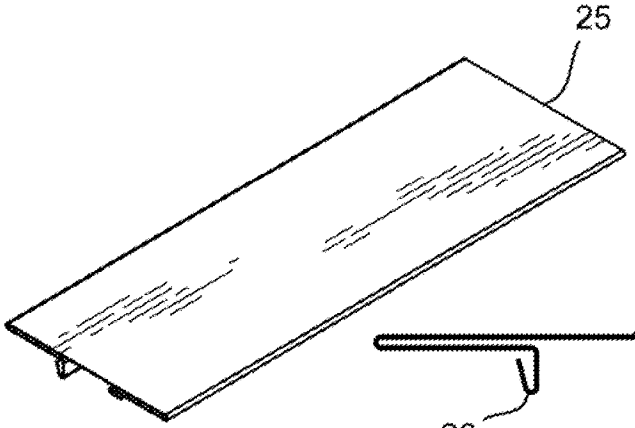
FIG. 12 is a fragmentary perspective view of a preferred embodiment of the apparatus of the present invention showing the panel cap with offset.

FIGS. 3-4 show a purlin 11 supporting multiple roof panels 21 having offset portions 24. Each roof panel 21 has multiple panel ribs 22. Each rib 22 can be a V or U shape in transverse cross section as seen in FIGS. 3-4 and 8-9. Each rib 22 has a water channel or interior space 35 that enables collection of rainwater. Rainwater thus drains from roof upper end 6 to roof lower end 7 via water conveying channels 35. FIGS. 6-7 show roof panel 28 having no offset portion. Panel 28 has panel ribs 29 on opposing sides of panel pan or planar section 30. In FIGS. 4-5 and 68-69, a bridge or bracket bridge 64 is used to bridge from one bracket 41 (or 42) to another bracket 41 (or 42) at a position where two anchor clip assemblies 40 come together. Bracket bridge 64 can have offset portions 43 and bracket pan or planar section 46. Bracket bridge 64 can have stiffening flange 45 and opposed inclined flanges 85 that each abut a panel rib 22 (see FIGS. 3-5). The bracket bridge 64 fills in a gap in between two brackets 41 (or 42) so that roof panels 18 (21 or 28) can be added.

Figure 10:
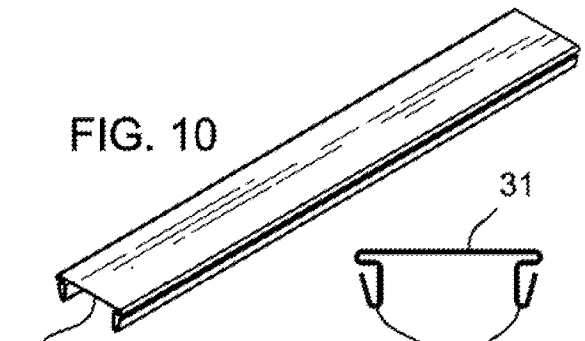
FIG. 10 is a fragmentary perspective view of a preferred embodiment of the apparatus of the present invention showing the panel cap with no offset.
Figure 11:
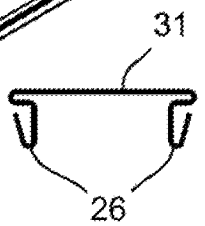
FIG. 11 is a fragmentary end view of a preferred embodiment of the apparatus of the present invention showing the panel cap with no offset.
Figure 52:
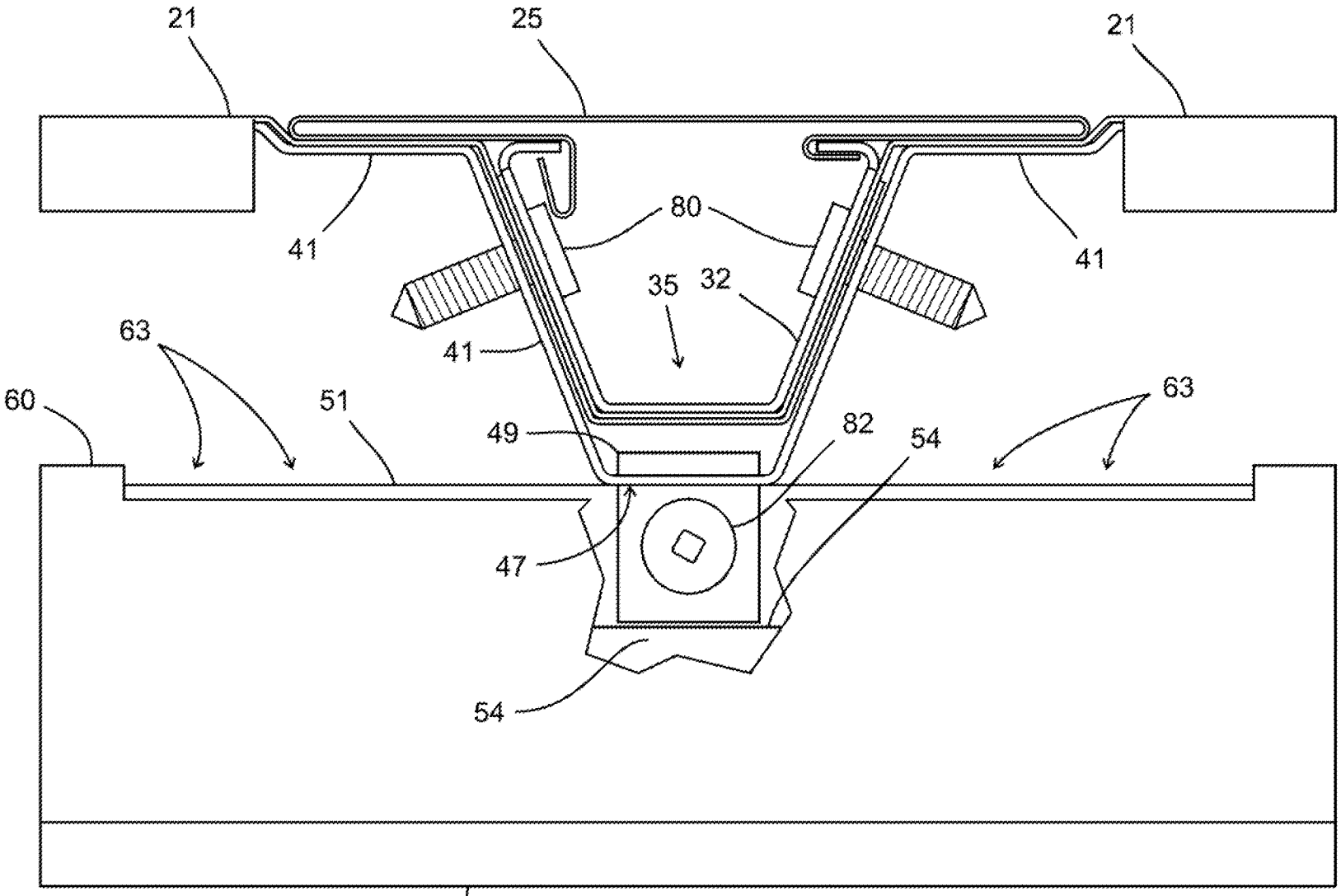
FIG. 52 is a partial sectional elevation view of a preferred embodiment of the apparatus of the present invention showing roof panel, bracket, sliding anchor, panel valley and shear clip mounted to a purlin.
Figure 53:
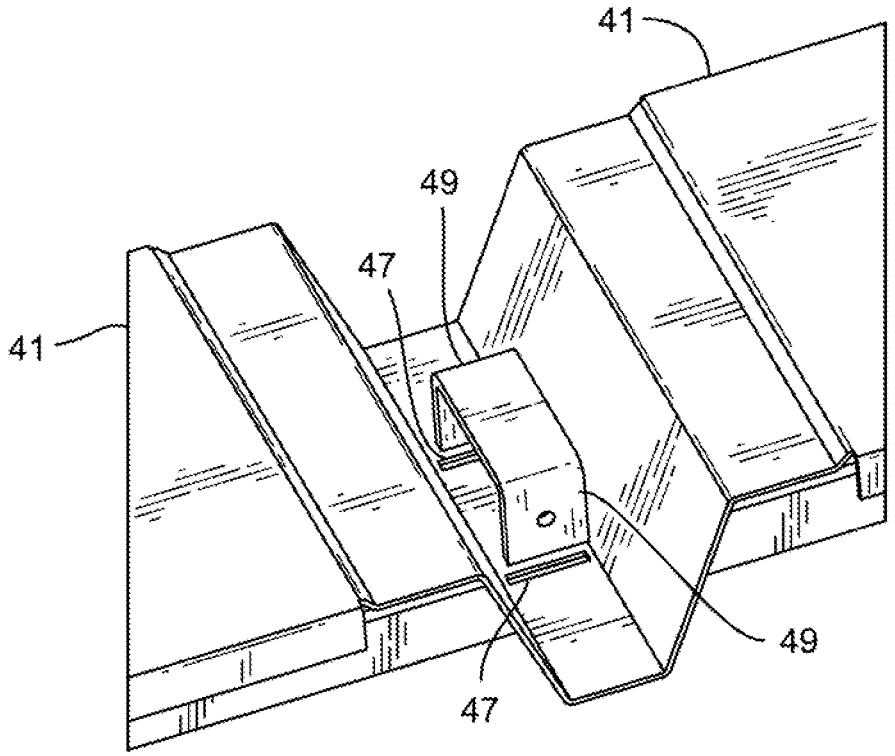
FIG. 53 is a partial perspective view of a preferred embodiment of the apparatus of the present invention.
Figure 54:
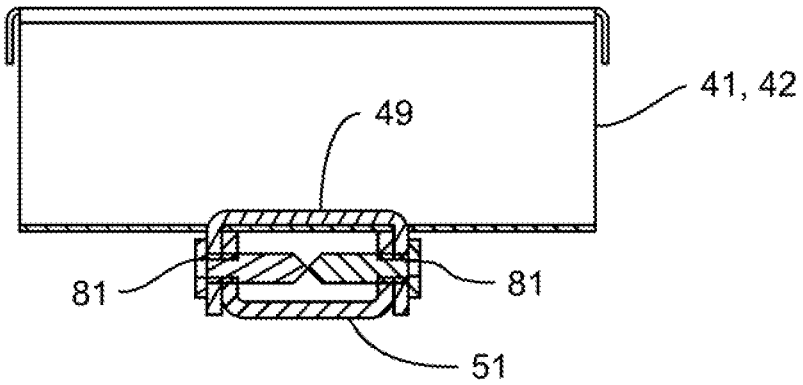
FIG. 54 is a partial elevation view of a preferred embodiment of the apparatus of the present invention.

Roof panel 21 (or roof panel 28) can be fitted with a panel cap that covers the panel rib 22 or 29 water conveying channel 35. In FIGS. 3-4, 12 and 13, panel cap 25 has snap lock 26 and slide lock 27 that each connect with a panel cap clip 32 as seen in FIGS. 3 and 52. In FIGS. 10-11 a panel cap 31 has snap lock portions 26 that each connect with panel cap clip 32 of FIGS. 14-17.

In FIGS. 14-17, panel cap clip 32 has bottom panel 48, opposed inclined sidewalls/flanges 86, and opposed snap locks 33 that connect with snap locks 26 of panel cap 31. In FIG. 52, fasteners 80 secure each panel cap clip 32 to overlapping panel ribs 22 or 29 and bracket 41 or 42. In FIGS. 1-2 and 52, panel cap 25 connects with roof panels 18 that can be panels 21 having offset portions 24.

Figures 56, 57, 58, 59, 60, 61:
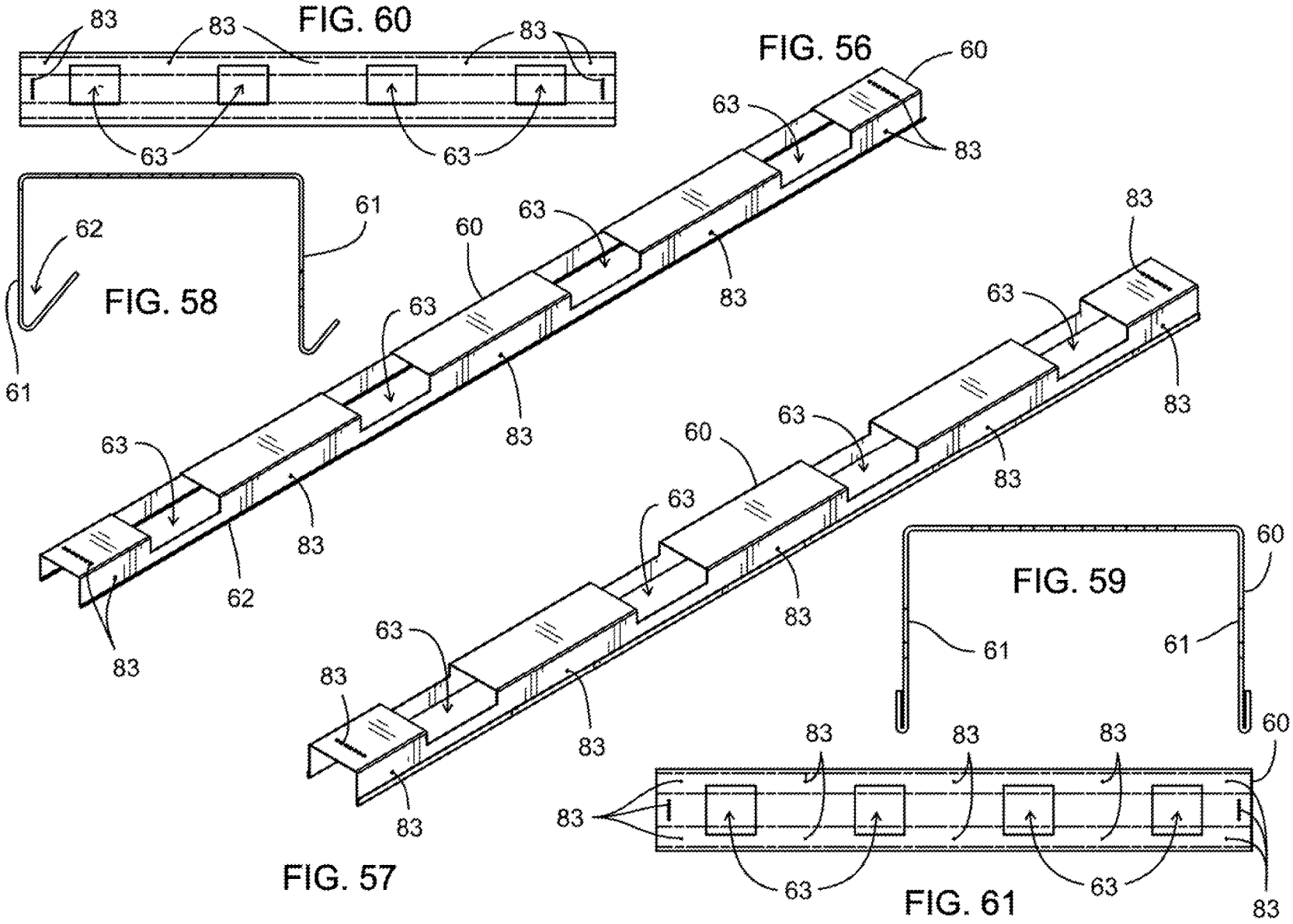
FIG. 56 is a partial perspective view of a preferred embodiment of the apparatus of the present invention showing the anchor clip assembly top plate for use with C channel and Z purlin beams.
FIG. 57 is a partial perspective view of a preferred embodiment of the apparatus of the present invention showing the anchor clip assembly top plate for use with a hat channel beam.
FIG. 58 is a partial end view of a preferred embodiment of the apparatus of the present invention showing the anchor clip assembly top plate for use with C channel and Z purlin beams.
FIG. 59 is a partial end view of a preferred embodiment of the apparatus of the present invention showing the anchor clip assembly top plate for use with a hat channel beam.
FIG. 60 is a partial flat pattern view of a preferred embodiment of the apparatus of the present invention showing the anchor clip assembly top plate for use with C-channel and Z purlin beams.
FIG. 61 is a partial flat pattern view of a preferred embodiment of the apparatus of the present invention showing the anchor clip assembly top plate for use with a hat channel.

Bracket 41 or 42 forms a connection between each roof panel 21 or 28 and anchor clip assembly or interface 40. Bracket 41 and the components of clip assembly 40 can be seen in FIGS. 29, 35-39 and 52. Bracket 41 can be seen in FIGS. 30-34. Bracket 41 has offset portions 43 for use with roof panels 21. Bracket 42 does not have offset portions and is configured to connect with roof panels 28 (no offset type). The clip assembly 40 includes bottom plate 54, top plate 60, sliding anchor 51, shear clips 49 and bracket 41 or 42 (see FIGS. 18-19, 21-22, 24-25, 29 and 52). Bottom plate 54 attaches to an underlying support beam 5 (e.g., purlin 11, web joist 12, hat channel 16 or U-beam 65, 66, 67). FIGS. 5, 24-26 and 52 show bottom plate 54 connected to purlin 11 (e.g., with fasteners 81). Top plate 60 has spaced apart openings 63 that enable bracket 41 downwardly projecting portions or inverted rib interior valley 44 to connect with sliding anchor 51 using shear clips 49 and bracket shear clip screws 82 (see FIGS. 40-42, 50 and 52). In FIGS. 57-58, top plate 60 can have vertical walls 61 and hook portions 62. Brackets 41, 42 each have slots 47 that are receptive of flanges 50 of shear clip 49. Sliding anchor 51 rests upon but is not affixed rigidly to bottom plate 54 (see FIGS. 26 and 52). Sliding anchor 51 and/or bottom plate 54 can be coated with a low friction material so that anchor 51 slides with little or reduced friction in all directions upon bottom plate 54. In FIGS. 43-46, sliding anchor 51 has a generally U-shaped cross section (FIG. 44), vertical walls or flanges 53, and bottom or weight bearing surface 52. Vertical walls/flanges 53 of anchor 51 provide openings 83 at intervals for receipt of fasteners 81 or 82. Because shear clip 49, bracket 41 (or 42), roof panels 21 (or 28), optionally panel cap clips 32 and panel cap 25 (or 31) are all affixed to sliding anchor 51, they move with sliding anchor 51 relative to bottom plate 54 and beam 5, responsive to expansion and contraction of roof panels 18 as typically occurs during each day.

FIGS. 18-20 show connection of clip assembly 40 to a hat channel beam 16. In FIGS. 18-20, the bottom plate becomes a hat channel beam. Hat channel beam 16 has horizontal flanges 17, vertical flanges 37 and top plate 38. In FIGS. 18-20, the top plate 38 of hat channel beam 16 can be used to replace bottom plate 54 of anchor clip assembly 40. Thus, sliding anchor 51 slides upon upper surface or bearing surface 36 of top plate 38. In FIGS. 18-20, top plate 60 is secured to hat channel beam 16 with fasteners 81. Shear clip 49 vertical flanges 50 extend through slots 47 of bracket 41 (or 42). Shear clip 49 vertical flanges 50 have openings 83 that are receptive of fasteners 81 that form a connection of each shear clip 49 to sliding anchor 51. Sliding anchor 51 has openings 83 that are receptive of fasteners 81 or 82 (see FIGS. 52-55).

Figures 62, 63, 64, 65, 66, 67:
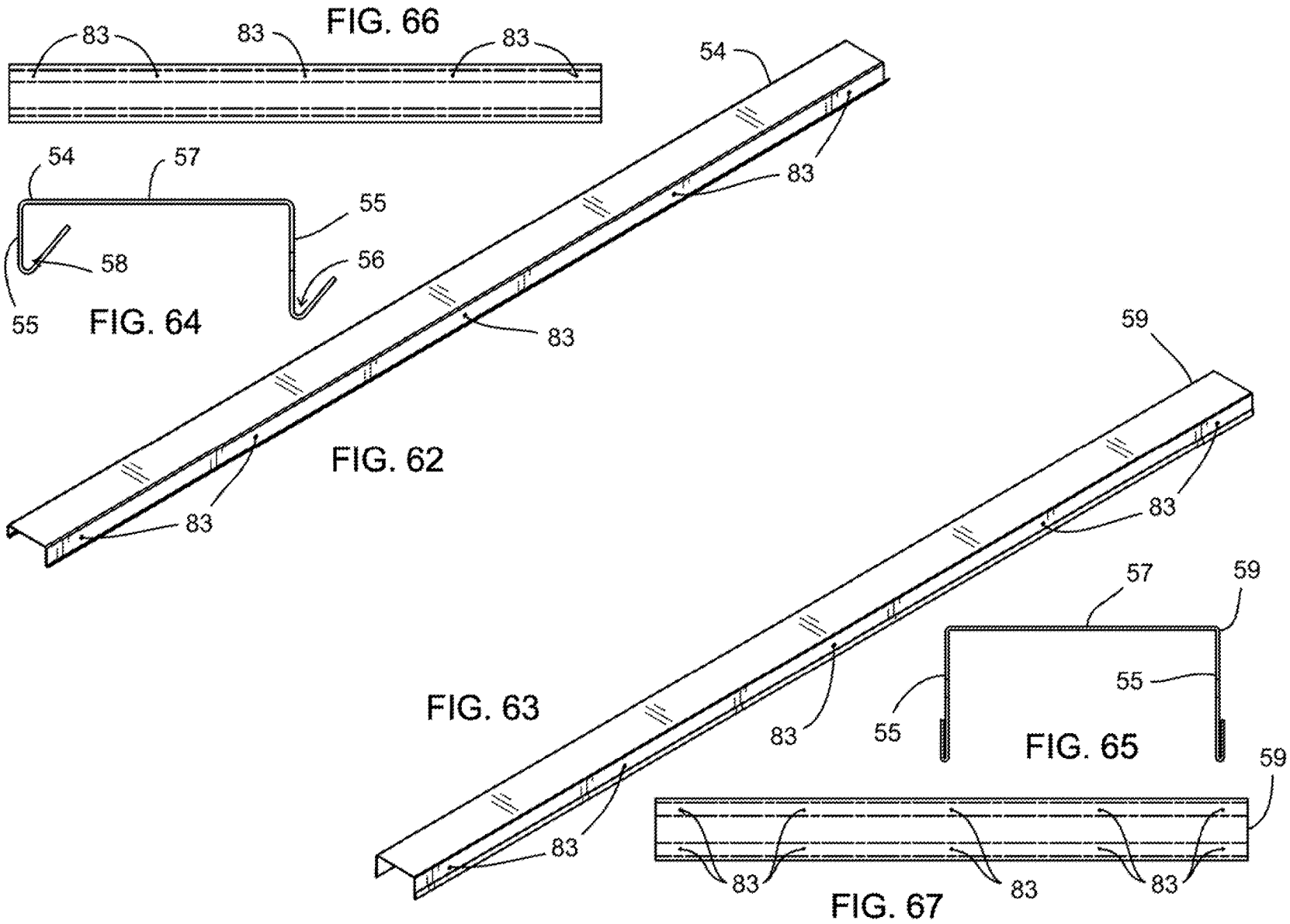
FIG. 62 is a partial perspective view of a preferred embodiment of the apparatus of the present invention showing the anchor clip assembly bottom plate for use with C-channel and Z purlin beams.
FIG. 63 is a partial perspective view of a preferred embodiment of the apparatus of the present invention showing the anchor clip assembly bottom plate for use with a hat channel.
FIG. 64 is a partial end view of a preferred embodiment of the apparatus of the present invention showing the anchor clip assembly bottom plate for use with C-channel and Z purlin beams.
FIG. 65 is a partial end view of a preferred embodiment of the apparatus of the present invention showing the anchor clip assembly bottom plate for use with a hat channel beam.
FIG. 66 is a partial flat pattern view of a preferred embodiment of the apparatus of the present invention showing the anchor clip assembly bottom plate for use with C-channel and Z purlin beams.
FIG. 67 is a partial flat pattern view of a preferred embodiment of the apparatus of the present invention showing the anchor clip assembly bottom plate for use with hat channel.
Figure 68:
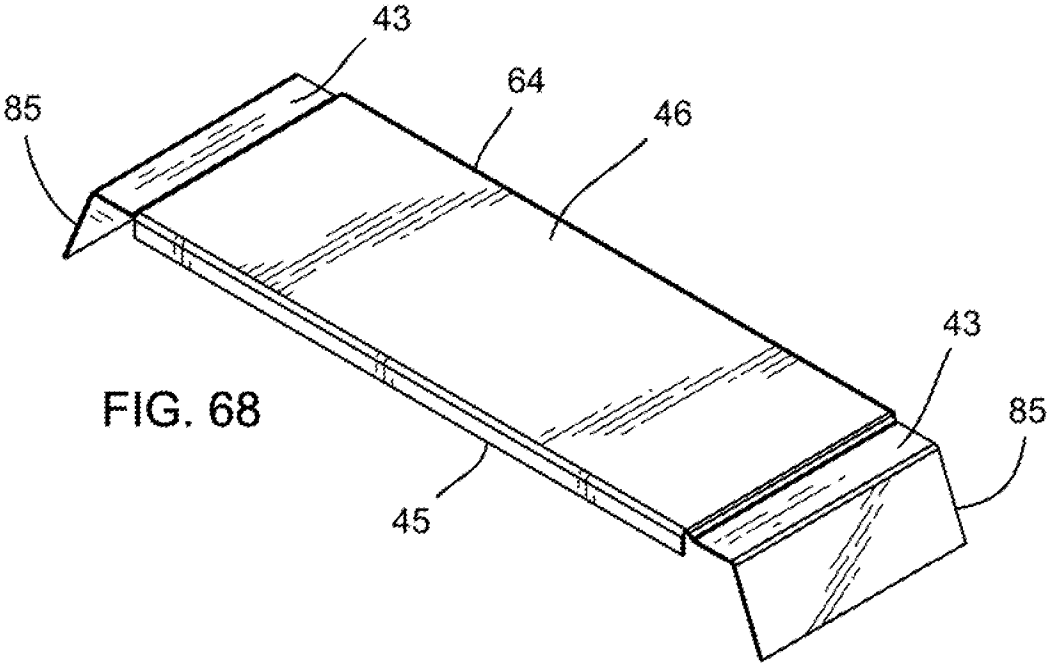
FIG. 68 is a perspective view of a preferred embodiment of the apparatus of the present invention showing the bracket bridge.

FIGS. 21-23 show connection of clip assembly 40 to a web joist 12. Web joist 12 has top cord 13, bottom cord 14, and web 15. Top cord 13 can be fitted with flanged beam 87. Bottom plate 59 provides a wear surface for receiving sliding anchor 51, as shown in FIG. 63. Fasteners 81 can be used to attach top plate 60 to beam 87. As with purlin 11, clip 49 and fasteners 81 attach with a selected bracket 41 or 42 to sliding anchor 51. Sliding anchor 51 then moves with clip 49, fasteners 82, bracket 41 (or 42) and selected roof panels/inverted panels 21 or 28 relative to bottom plate/beam 87.

FIGS. 27-28 show attachment of brackets 41 to a C-channel or channel beam 19. Fasteners 81 attach bottom plate 54 to beam 19 having top flange 73, bottom flange 74 and web 75. Top plate 60, clip 49 and fasteners 82 then attach sliding anchor 51 to bracket 41 (or 42). Dotted line 76 in FIG. 28 illustrates that beam 19 can be a Z purlin instead of a C-channel with dotted line 76 being the bottom flange of the Z purlin, replacing bottom flange 74 of the C-channel. Flange 73 has vertical section/member 77. Flange 74 has vertical section/member 78. Z purlin bottom flange shown by dotted line 76 has vertical section/member 79.

Figure 88:
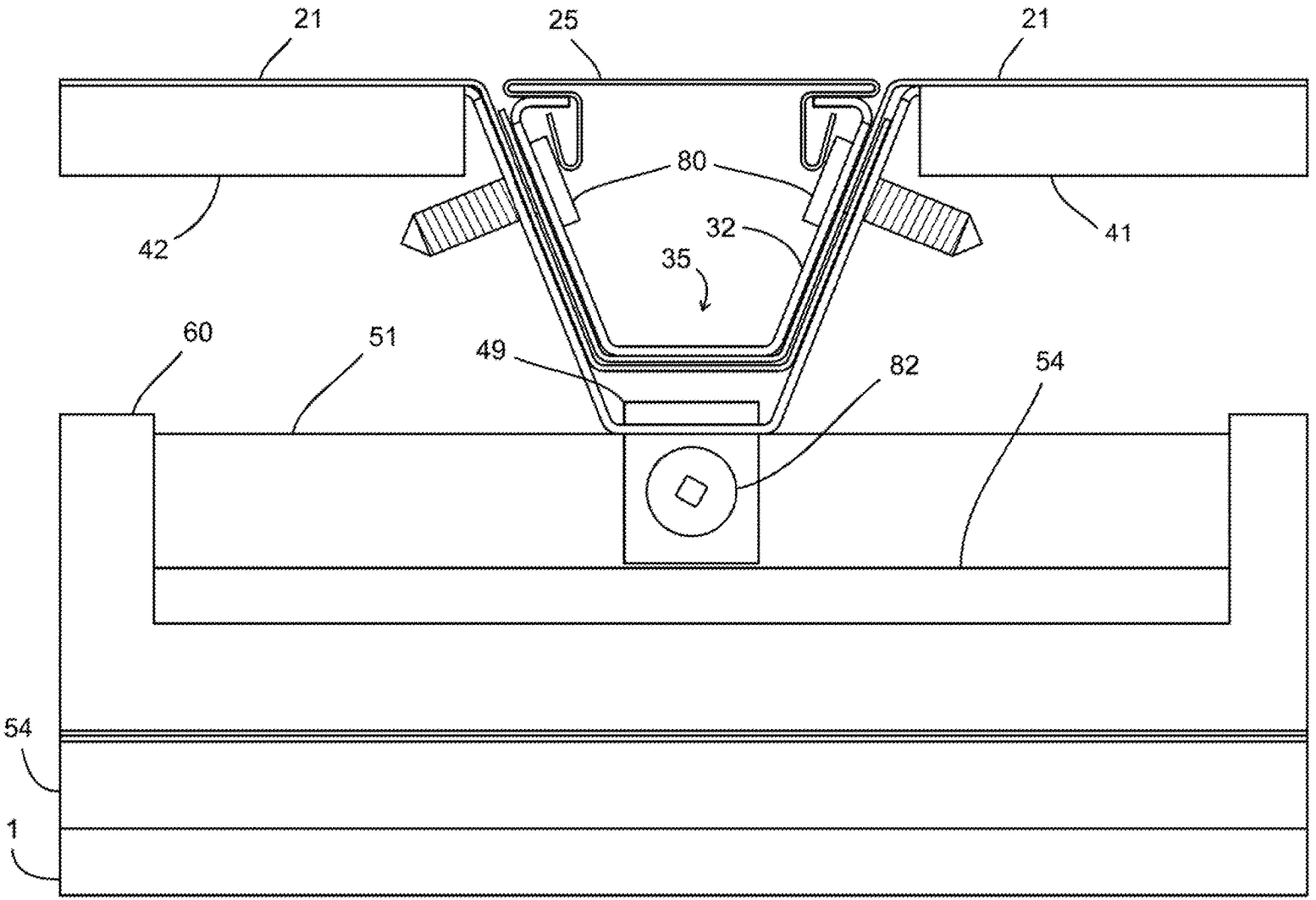
FIG. 88 is a partial section elevation view of an alternate embodiment of the apparatus of the present invention.

In FIGS. 52 and 88, the selected beam 5 such as purlin 11 is connected to the selected bracket 41 (or 42) to which overlapping roof panels 21 are connected using clip 32 and fasteners 80. Thus, each fastener 80 extends through clip 32, a first roof panel 21, a second roof panel 21 and bracket 41 (or 42). Bracket 41 or 42 is secured to sliding anchor 51 using clip 49 and fasteners 82.

Figure 55:
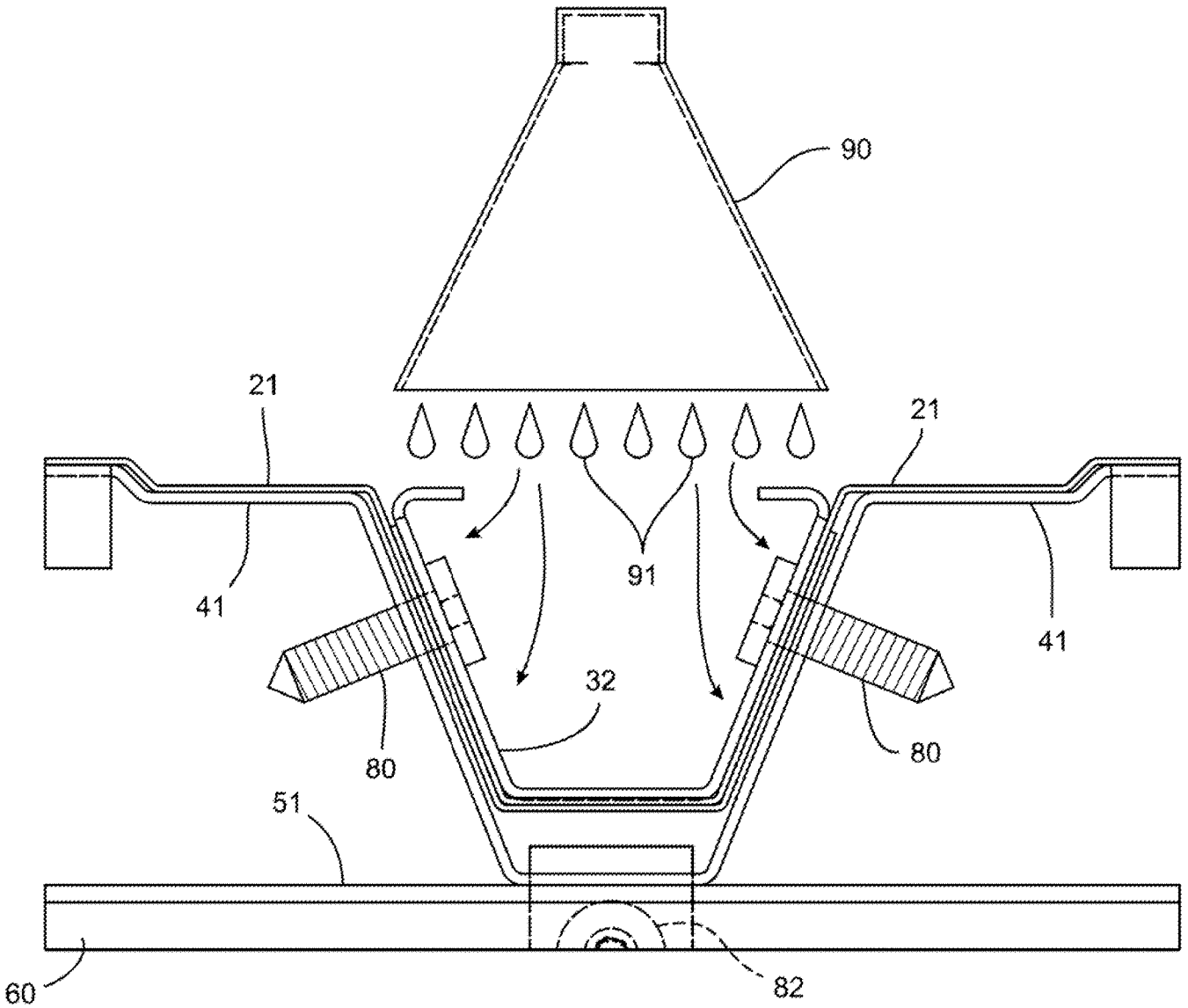
FIG. 55 is a partial sectional elevation view of a preferred embodiment of the apparatus of the present invention illustrating application of water coating chemical such as undercoating.

FIG. 55 illustrates that a spray nozzle or other dispenser 90 can be used to spray a sealant or sealing chemical 91 into clip 32 thus preventing any leakage of water at the overlap of panels 21, bracket 41, fasteners 80 and clip 32. Such a chemical can be an undercoat (e.g., Valugard 160 MilSpec by Sherwin Williams®).

FIGS. 56-61 show different configurations for top plate 60. FIG. 59 is an end view showing top plate 60 with side walls or vertical walls 61. In FIGS. 57 and 61, the top plate 60 has the wall configuration of FIG. 59. FIGS. 57 and 61 show spaced apart openings 63 through which extends clip 49, bracket 41 (or 42) and roof panel 21 (or 28) as seen in FIG. 52. FIGS. 57, 58 and 60 show top plate 60 having vertical wall 61 and top plate hooks 62. The top plate 60 of FIGS. 57, 58 and 60 can be used when beam 5 is a purlin 11 such as a Z purlin as seen in FIG. 26. Bottom plate 54 (FIGS. 62, 64, and 66) has vertical walls 55, glue channel 56, weight bearing surface 57 and bottom plate hook 58. As seen in FIG. 26, hooks 58 and 62 both engage purlin 11, hook 58 is the inner most hook while top plate hook 62 wraps around both purlin 11 and bottom plate hook 58. Similarly, bottom plate 54 has a glue channel 56 that connects with/overlaps the hooks 62 of top plate 60 as seen in FIG. 26. Bottom plate 59 for hat channel beams 16 or web joists 12 has vertical walls 55 and weight bearing surface 57, as shown in FIGS. 63, 65, and 67.

Figure 70:
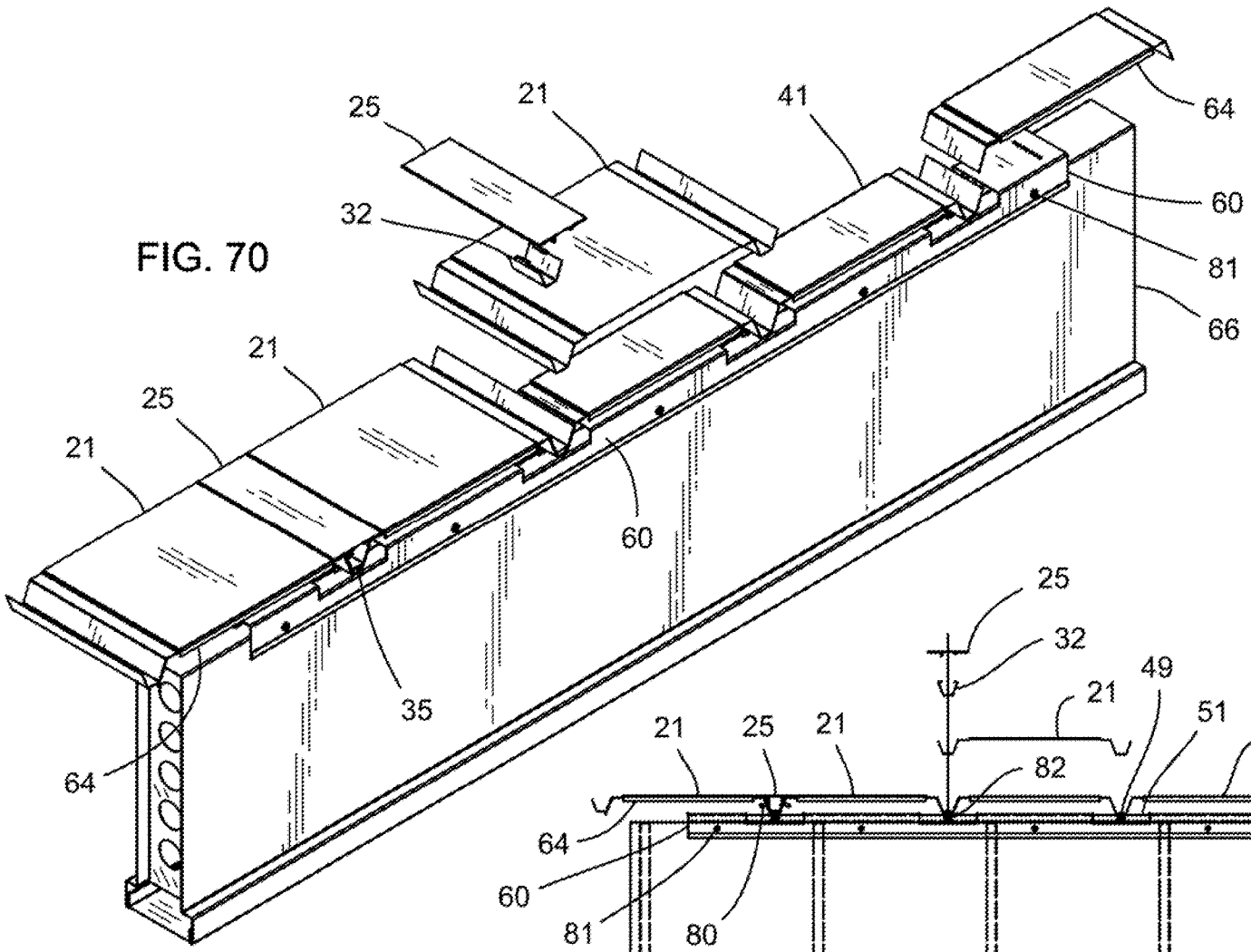
FIG. 70 is a perspective view of an alternate embodiment of the apparatus of the present invention with the bottom plate in the form of a U-beam.
Figure 71:
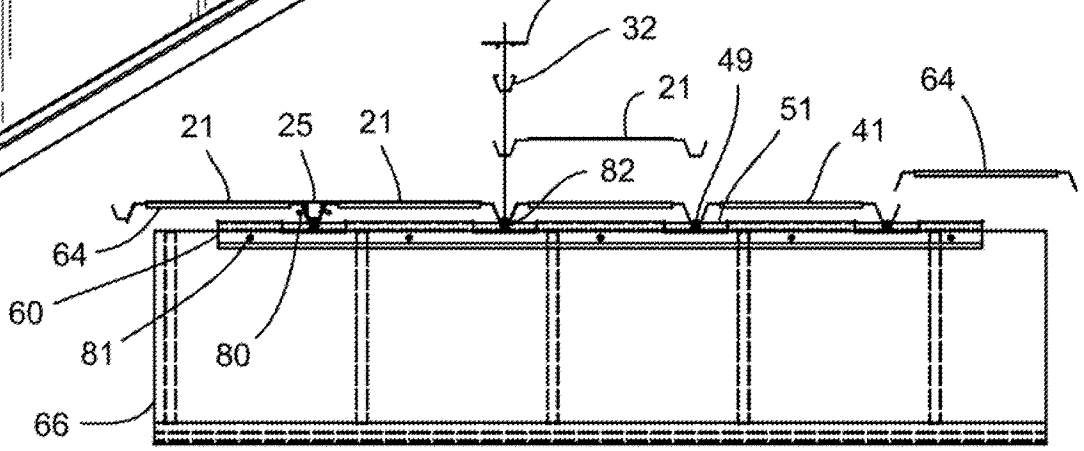
FIG. 71 is an elevation view of an alternate embodiment of the apparatus of the present invention with the bottom plate in the form of a U-beam.

FIGS. 70-88 show U-beams 65-67 that can be used with anchor clip assembly 40 to support a selected plurality of roof panels 18 (21 or 28). FIGS. 70-71 show U-beam 66 (wide compartment version) supporting roof panels 21. In FIGS. 70-71, bottom plate 54, sliding anchor 51, top plate 60, bracket 41 or 42, bracket bridge 64, roof panels 21 or 28 and panel caps 25 or 32 are affixed in the same fashion as shown and described with reference to FIG. 52.

Figure 72:
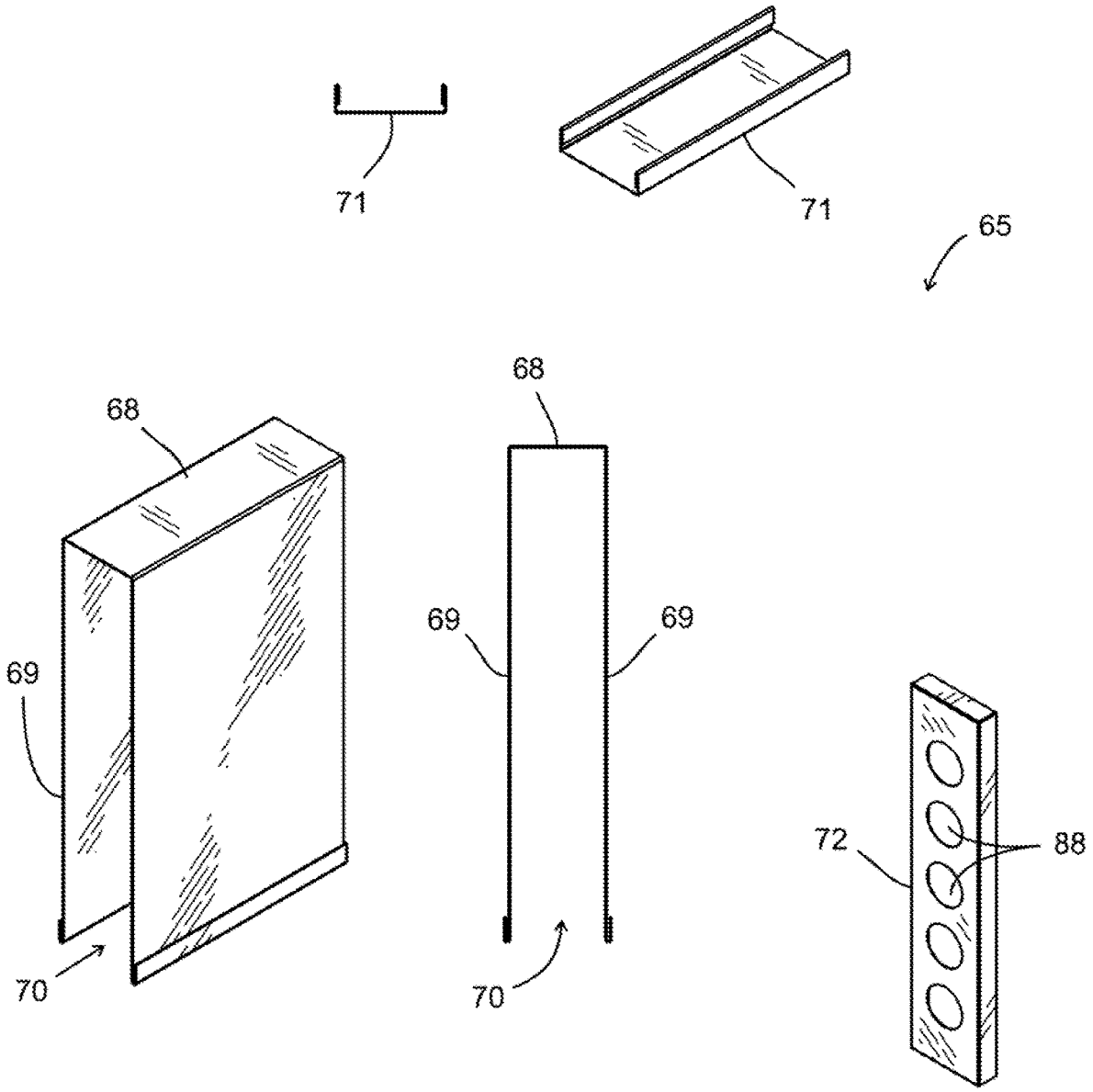
FIG. 72 is a fragmentary perspective exploded view of an alternate embodiment of the apparatus of the present invention.
Figure 73:
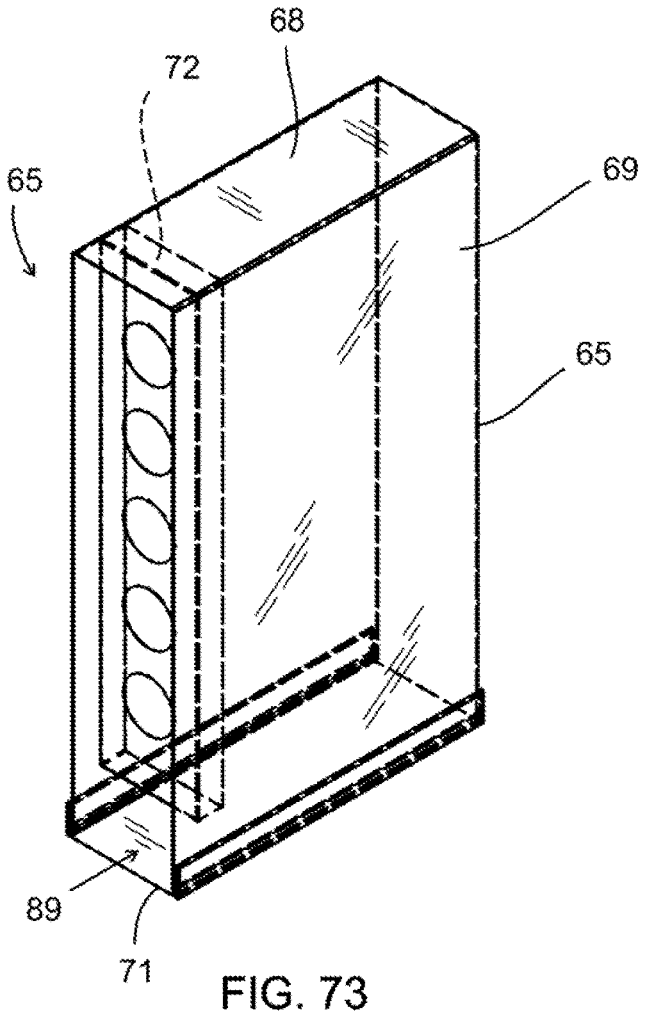
FIG. 73 is a fragmentary perspective view of an alternate embodiment of the apparatus of the present invention.
Figure 74:
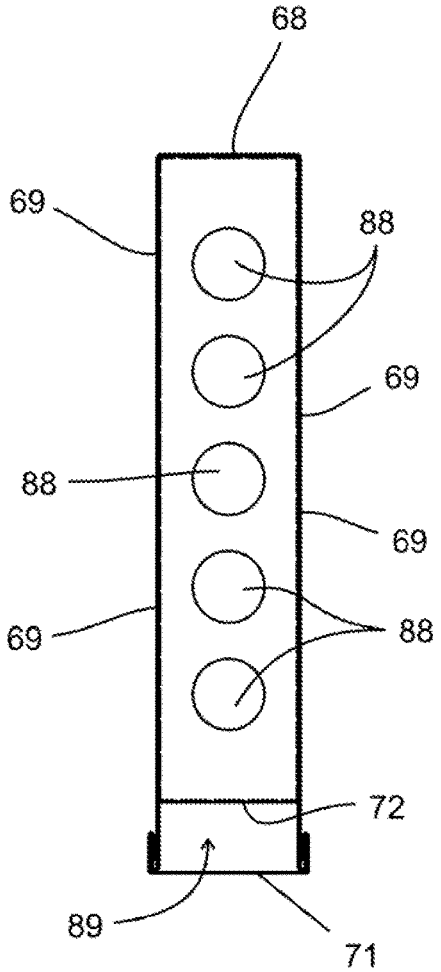
FIG. 74 is a fragmentary end view of an alternate embodiment of the apparatus of the present invention.
Figure 75:
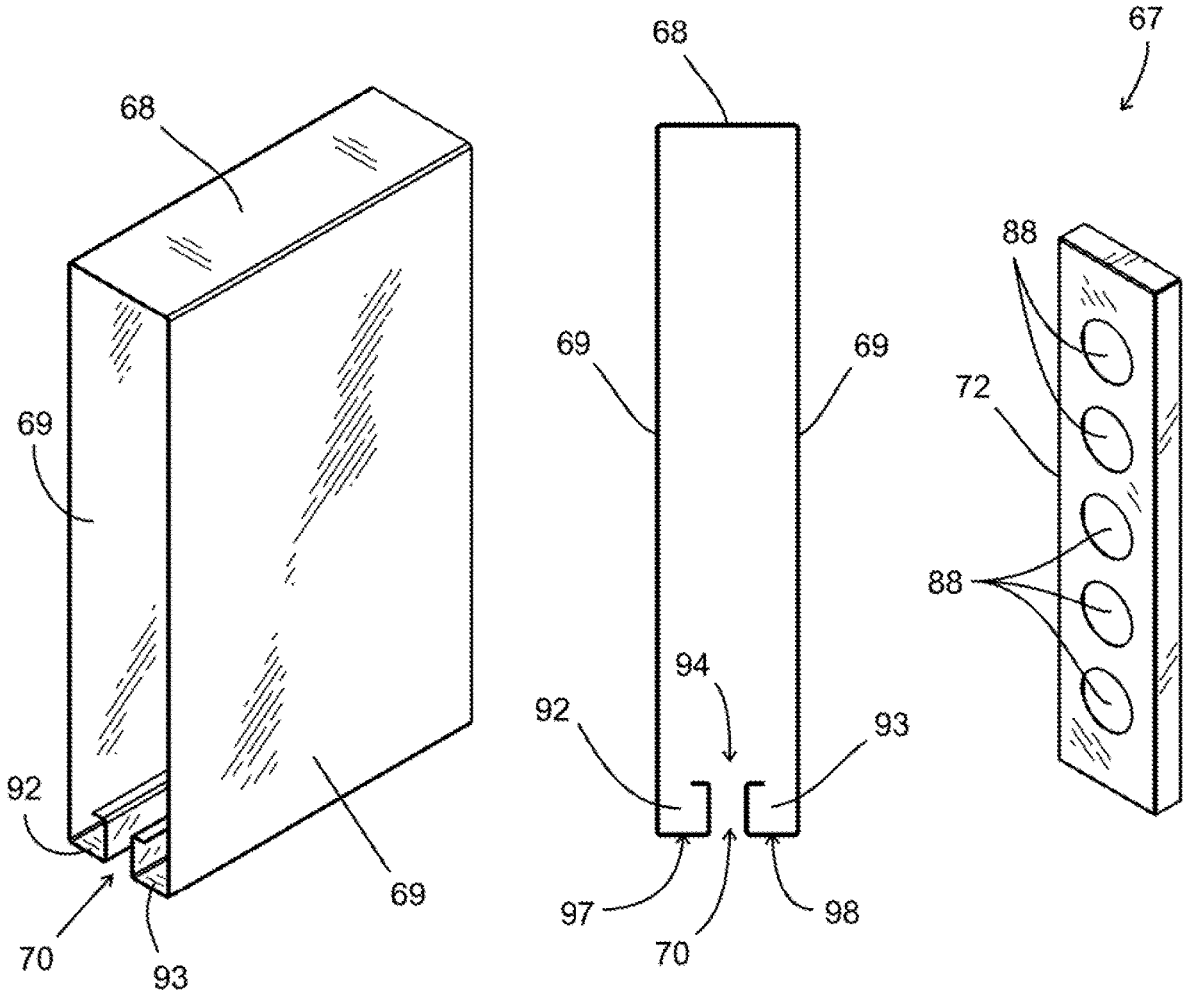
FIG. 75 is a fragmentary exploded perspective view of the alternate embodiment of the apparatus of the present invention.
Figure 76:
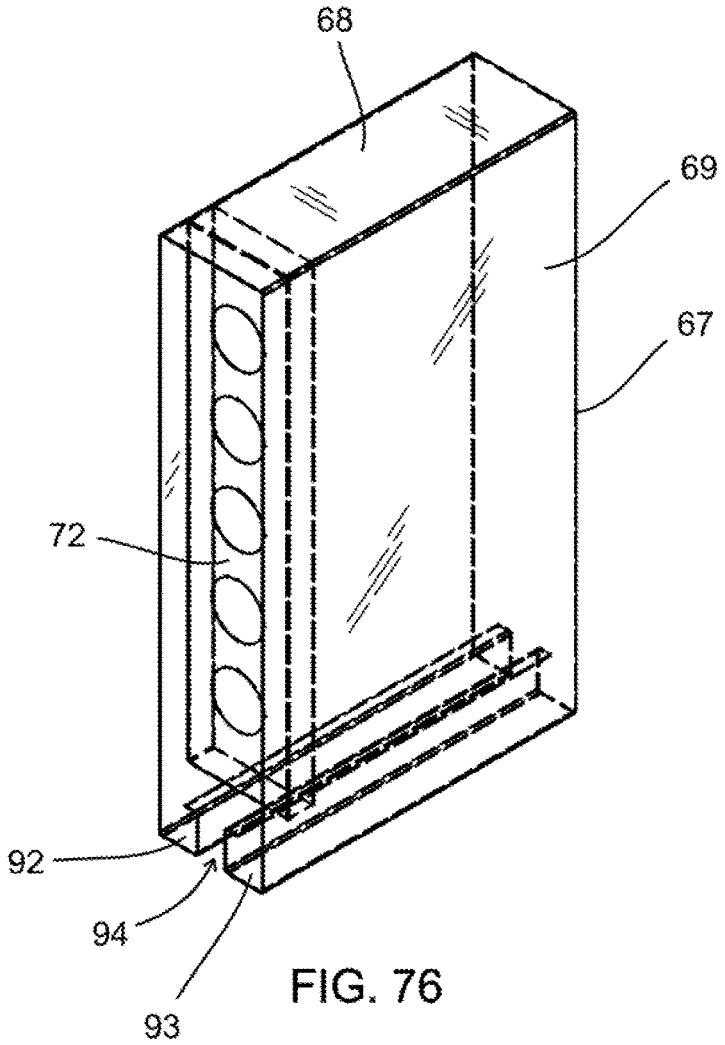
FIG. 76 is a fragmentary perspective view of an alternate embodiment of the apparatus of the present invention.
Figure 77:
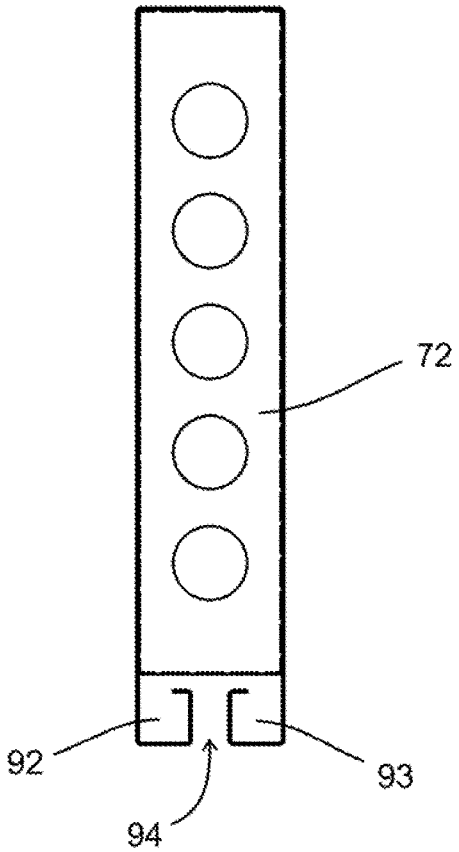
FIG. 77 is a fragmentary end view of an alternate embodiment of the apparatus of the present invention.
Figure 78:
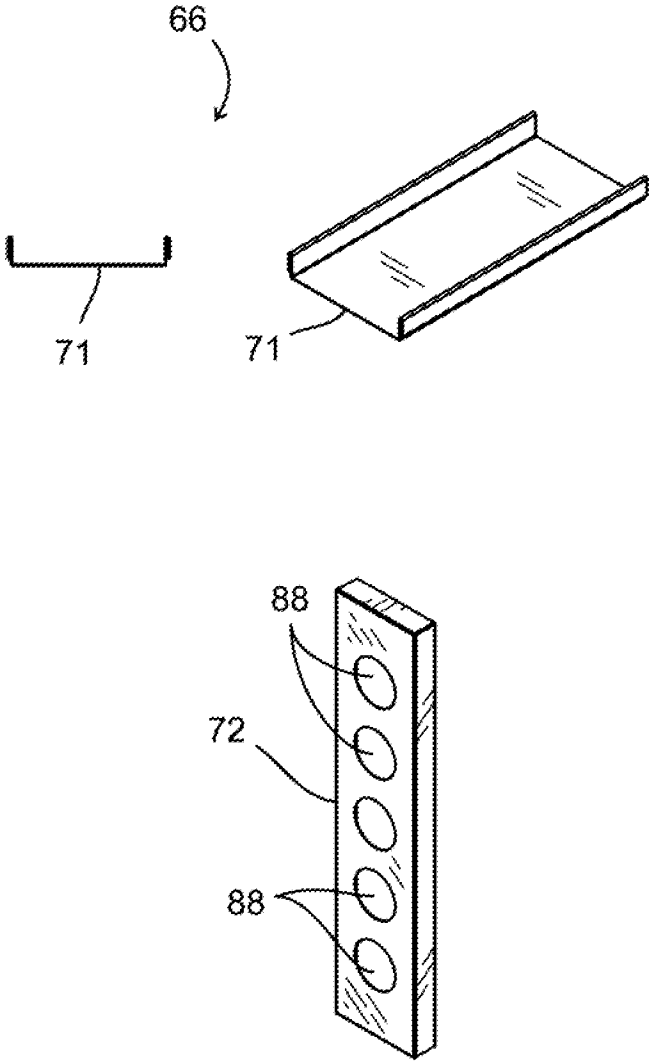
FIG. 78 is an exploded perspective view of an alternate embodiment of the apparatus of the present invention.
Figure 78:
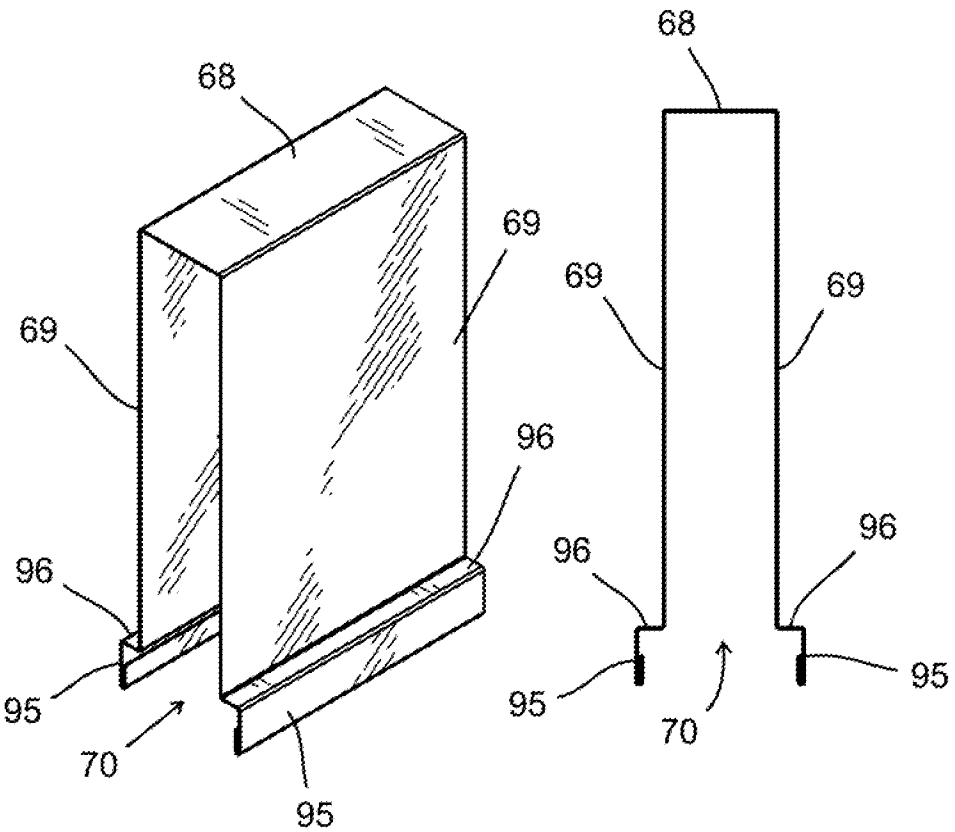
Figure 79:
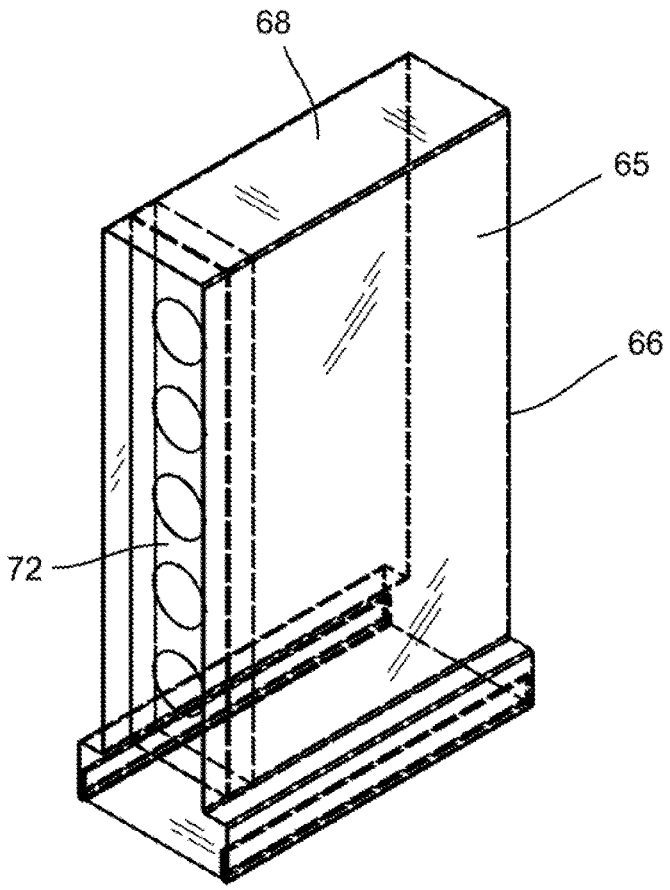
FIG. 79 is a partial perspective view of an alternate embodiment of the apparatus of the present invention.
Figure 80:
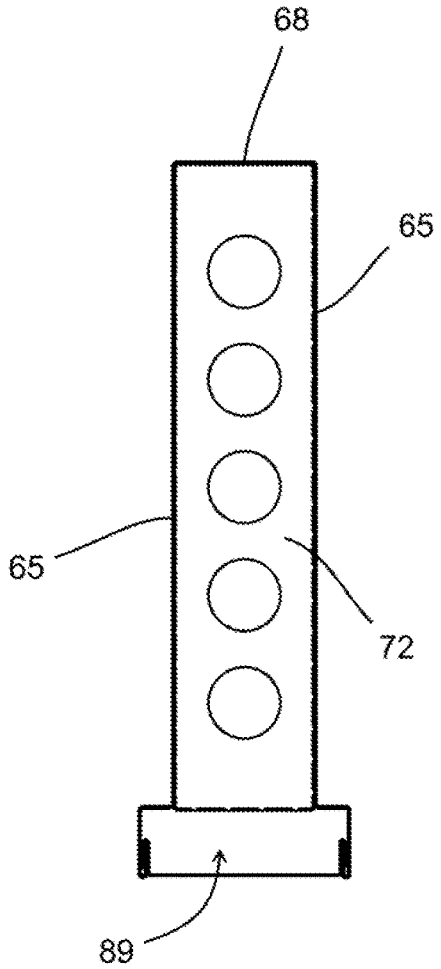
FIG. 80 is a fragmentary end view of an alternate embodiment of the apparatus of the present invention.
Figure 81:
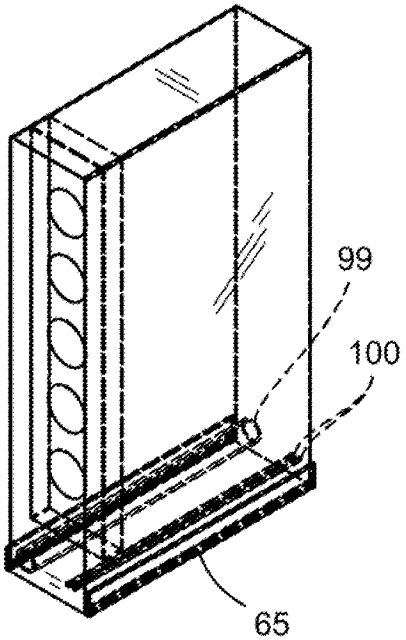
FIG. 81 is a partial perspective view of an alternate embodiment of the apparatus of the present invention.
Figure 82:
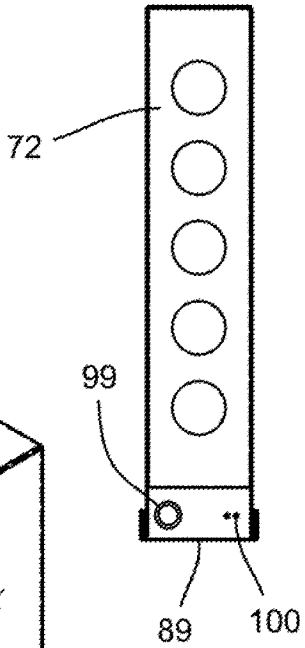
FIG. 82 is a partial end view of an alternate embodiment of the apparatus of the present invention.
Figure 83:
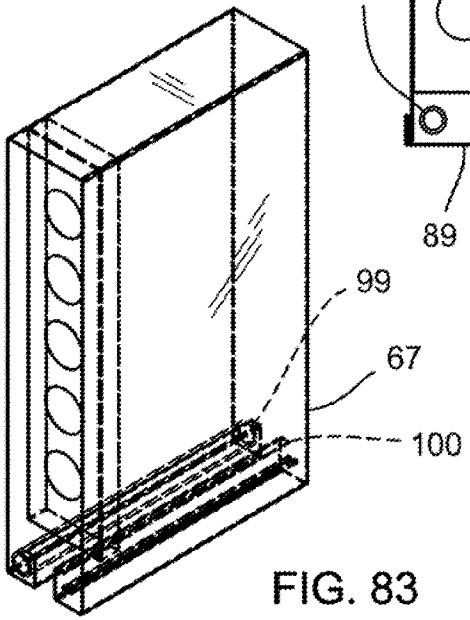
FIG. 83 is a partial perspective view of an alternate embodiment of the apparatus of the present invention.
Figure 84:
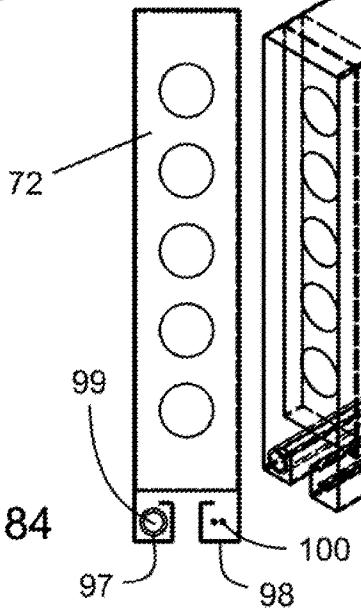
FIG. 84 is a partial end view of an alternate embodiment of the apparatus of the present invention.
Figure 85:
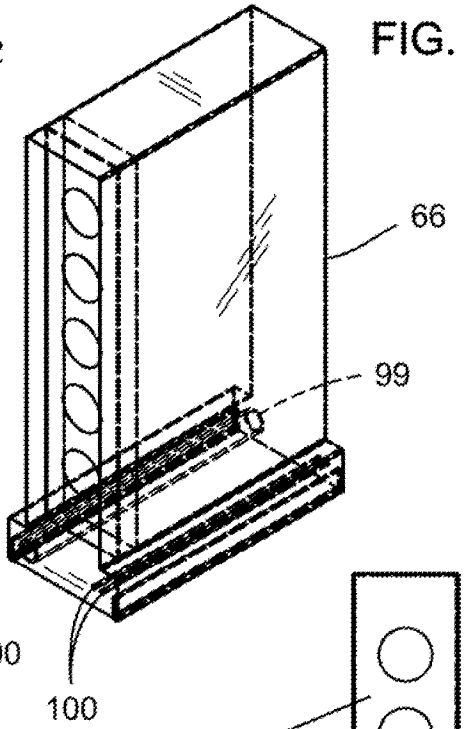
FIG. 85 is a partial perspective view of an alternate embodiment of the apparatus of the present invention.
Figure 86:
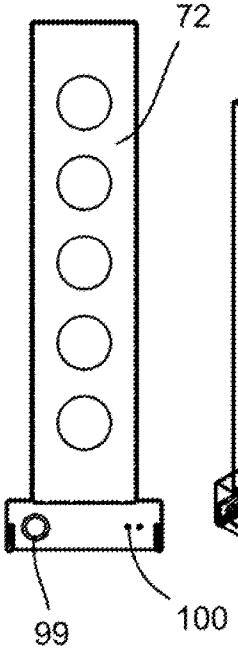
FIG. 86 is a partial end view of an alternate embodiment of the apparatus of the present invention.

FIGS. 72-86 show three configurations of U-beams including standard compartment 65, wide compartment 66 and double compartment 67. FIGS. 72-74 show standard compartment U-beam 65. U-beam 65 has a top flange 68, a pair of generally parallel webs 69, compartment area 70 and closure plate 71. The webs 69 and top flange 68 can be reinforced at intervals with apertured closure plate 72. Each closure plate can have spaced apart openings 88. A longitudinally extending passageway 89 enables routing of one or more selected utilities in beam 65 at cover plate 71 and below plates reinforcing plates 72. Utilities to be contained in passageway 89 can be piping, electrical wiring, telephone wiring, computer cabling or other cabling. FIGS. 75-77 show U-beam double compartment 67. U-beam 67 has a lower end portion with spaced apart components 92, 93 and gap 94 between compartments 92, 93. Each compartment can contain one or more selected utilities. As with U-beam 65, U-beam 67 can be reinforced at intervals with apertured panels 72. In FIGS. 78-80 there is seen U-beam wide compartment 66 wherein passageway 89 extends laterally beyond each web 69. U-beam 66 has wider closure plate 71 when compared to U-beam 65. Passageway 89 is bordered by closure plate 71, vertical flanges 95 and horizontal flanges 96.

FIGS. 81-86 are illustrative of utilities carried in passageways 89, 97, 98. Piping is designated by the numeral 99. Wiring or cabling is designated by the numeral 100.

Figure 87:
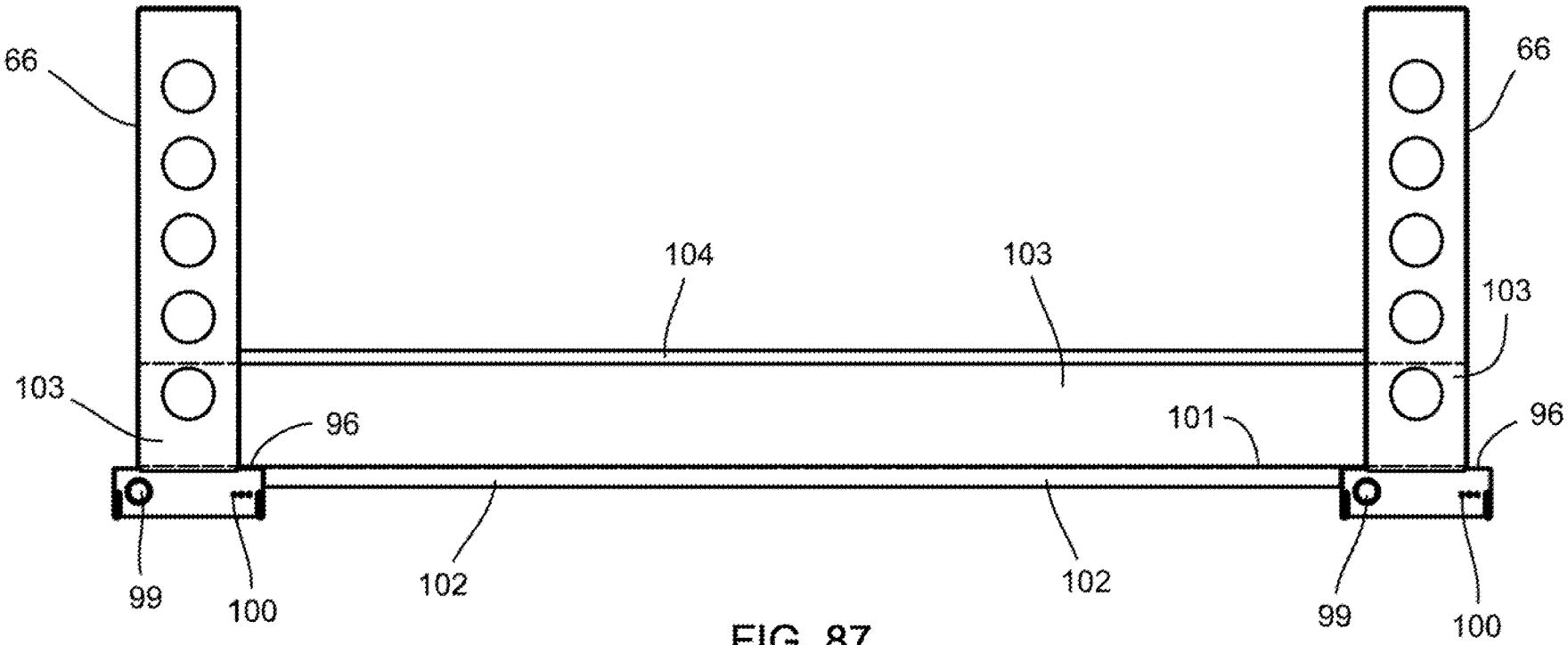
FIG. 87 is an elevation view of an alternate embodiment of the apparatus of the present invention including ceiling material/tiles, insulation, and fireboard layers.

In FIG. 87, there is illustrated the use of two U-beams 66 used to support not only roof panels using anchor clip assembly 40 as described herein, but also ceiling parts. In FIG. 87, rods 101 can be spaced apart (e.g., 2-5 feet) and each rod 101 spanning from one U-beam 66 to another U-beam 66. The rods 101 can rest upon horizontal flanges 96. Attached to rods 101 or suspended from clip assembly 40 with wires are ceiling tiles 102 or other ceiling material such as wood strips, wood panels, or other ceiling material. Insulation 103 can be layered above rods 101 and ceiling material 102. An upper fire rated or fire-retardant material 104 can be placed above insulation 103.

Parts List

The following is a list of parts and materials suitable for use in the present invention:

Parts Number Description

1 building
2 slab/foundation
3 vertical support/column
4 inclined member
5 beam
6 upper end
7 lower end
10 roof apparatus
11 purlin
12 web joist
13 top cord
14 bottom cord
15 web
16 hat channel/hat channel beam
17 hat channel flange
18 roof panel
19 C-channel/channel beam
21 inverted panel (offset type)
22 panel rib
23 panel pan/planar section
24 panel offset/offset portion
25 panel cap (offset type)
26 snap lock
27 slide lock
28 inverted panel (no offset type)
29 panel rib (no offset type)
30 panel pan (no offset type)/planar section
31 panel cap (no offset type)
32 panel cap clip
33 snap lock (no offset type)
35 water channel
36 upper surface/bearing surface
37 vertical flange
38 top plate
40 anchor clip assembly/interface
41 bracket (offset type)
42 bracket (no offset type)
43 bracket offset/offset portion
44 inverted rib interior valley/downwardly projecting portion
45 stiffening flange
46 bracket pan
47 shear clip slot/slot
48 bottom panel
49 shear clip
50 shear clip vertical wall/flange
51 sliding anchor
52 sliding anchor weight-bearing surface
53 sliding anchor vertical wall/flange
54 bottom plate (purlin/C channel)
55 bottom pate vertical wall
56 bottom plate glue channel
57 bottom plate weight-bearing surface
58 bottom plate hook
59 bottom plate (hat channel/web joist)
60 top plate
61 top plate vertical wall/side wall
62 top plate hook
63 top plate opening
64 bracket bridge
65 U-beam standard compartment/U-beam
66 U-beam wide compartment/U-beam
67 U-beam double compartment/U-beam
68 U-beam top flange
69 U-beam web
70 U-beam compartment area
71 U-beam closure plate
72 U-beam internal support/apertured closure plate
73 top flange
74 bottom flange
75 web
76 Z purlin bottom flange
77 vertical section/member
78 vertical section/member
79 vertical section/member
80 panel screw/fasteners/screw/bolt
81 clip screws/fasteners
82 bracket shear clip screws/fasteners/screw/bolt
83 fastener holes
84 downwardly projecting portion
85 inclined flange
86 inclined side wall/flange
87 flanged beam
88 opening
89 cavity/passageway
90 nozzle/dispenser
91 waterproofing chemical
92 compartment
93 compartment
94 gap
95 vertical flange
96 horizontal flange
97 passageway
98 passageway
99 piping/pipe
100 wiring/cabling
101 rod
102 ceiling tile/ceiling material
103 insulation
104 fire retardant layer All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A roof apparatus, comprising:

a) multiple supporting members that are selected from purlins, channels, joists, U-beams or hat channels;

b) clip assemblies on said supporting members, each said clip assembly including a bottom member, a top member, and a sliding anchor;

c) multiple roof panels that each have an upper portion, a lower portion, wherein an edge portion of one said roof panel connects to an edge portion of another roof panel;

d) valley portions on each roof panel that enable collection of rainwater and a channeling of the rainwater to each roof panel lower portion, each valley portion having a bottom; and e) a shear connection that fasten each roof panel to a sliding anchor above the valley portion bottom.

2. The roof apparatus of claim 1 further comprising a panel cap that connects to said roof panel at a said valley portion.

3. The roof apparatus of claim 2 further comprising a panel cap fitting that occupies a said valley portion and fasteners that connect said panel cap fitting to a said valley portion.

4. The roof apparatus of claim 1 wherein said sliding anchor is able to move in all directions relative to said top member.

5. The roof apparatus of claim 1 wherein said sliding anchor is able to move in multiple directions relative to said top and bottom plates.

6. The roof apparatus of claim 1 wherein said top member has spaced apart openings and each valley portion connects to said sliding member next to a said top member opening.

7. The roof apparatus of claim 1 wherein the shear connection includes fasteners that extend through a said panel cap fitting, a said bracket, and a said roof panel.

8. A roof apparatus, comprising:

a) multiple supporting members that are part of a building frame;

b) multiple roof panels that each have edge portions, an upper portion, a lower portion, wherein an edge portion of one said roof panel connects to an edge portion of another said roof panel;

c) a connection assembly that forms an interface between said support members and said roof panels that enables the roof panels to move 360 degrees relative to said supporting members;

d) said connection assembly including a bottom member, a top member having spaced apart top member openings, a sliding anchor that is movable in multiple directions relative to said top and bottom members and brackets that are connected to the sliding anchor; and e) one or more fittings that connect the roof panels and brackets to said sliding anchors, each said fitting extending through a top member opening.

9. The roof apparatus of claim 8 further comprising a panel cap that connects to said roof panel at a said channel portion.

10. The roof apparatus of claim 9 further comprising a panel cap fitting that occupies a said valley portion and fasteners that connect said panel cap fitting to a said channel portion.

11. The roof apparatus of claim 8 wherein said sliding anchor is able to move in all directions relative to said top member.

12. The roof apparatus of claim 8 wherein each said support member is selected from a group that includes purlin, joist, hat channel, U-beam.

13. The roof apparatus of claim 8 wherein each valley portion has a U or V shape in transverse cross section.

14. A metal building apparatus, comprising:

a) multiple supporting members that are part of a framework;

b) multiple metal roof panels that each have a top portion, a bottom portion, an edge portion of one said roof panel connecting to an edge portion of another roof panel;

c) a bracket that includes multiple panels and multiple bracket valleys, said bracket positioned below said roof panels;

d) a connection assembly that forms an interface between said multiple support members and said roof panels;

e) said connection assembly including a bottom member, a top member having spaced apart top member openings and a sliding anchor that is movable in multiple directions relative to said top and bottom members;

f) one or more fittings that connect the roof panels to said sliding anchors, each said fitting extending through a top member opening; and g) each supporting member having opposed, parallel webs, an upper plate having an upper surface, a lower end portion and multiple spaced apart reinforcing members that each connect to said webs.

15. The metal building apparatus of claim 14 further comprising a longitudinally extending passageway that enables carriage of electrical lines, piping or other wiring.

16. The metal building apparatus of claim 15 wherein said passageway is positioned below said reinforcing members.

17. The metal building apparatus of claim 15 wherein said webs are spaced apart a first distance and said passageway is a second distance wide that is a greater distance than said first distance.

18. The metal building apparatus of claim 15 wherein said passageway includes two spaced apart compartments with a gap in between said compartments.

19. The metal building apparatus of claim 14 wherein said bottom member is the upper surface of said upper plate.

20. The metal building apparatus of claim 15 further comprising piping contained in said passageway.

* * * * *